US005517545A

United States Patent [19]

Nakamura et al.

[11] Patent Number: 5,517,545

[45] Date of Patent: May 14, 1996

[54] X-RAY APPARATUS

[75] Inventors: Tsutomu Nakamura; Takane Yokoi; Yutaka Ochiai; Mitsumasa Furukawa; Hiroki Kawakami; Tadaoki Matsushita; Harumoto Sawada; Toshihiro Suzuki, all of Hamamatsu, Japan

[73] Assignee: Hamamatsu Photonics K.K., Hamamatsu, Japan

[21] Appl. No.: 276,159

[22] Filed: Jul. 15, 1994

[30] Foreign Application Priority Data

Jul. 15, 1993 [JP] Japan ..... 5-175734

[51] Int. Cl.[6] ..... H05G 1/32

[52] U.S. Cl. ..... 378/101; 378/108; 378/109; 378/111; 378/138

[58] Field of Search ..... 378/119, 121, 378/110, 111, 112, 113, 109, 108, 101, 145, 138, 137

[56] References Cited

U.S. PATENT DOCUMENTS

| | | | |
|---|---|---|---|
| 4,439,869 | 3/1984 | Hermeyer et al. | 378/113 |
| 4,646,338 | 2/1987 | Skillicorn | 378/110 |
| 4,694,480 | 9/1987 | Skillicorn | 378/119 |
| 4,797,905 | 1/1989 | Ochmann et al. | 378/108 |
| 4,930,145 | 5/1990 | Sherwin et al. | 378/112 |
| 4,995,069 | 2/1991 | Tanaka | 378/200 |
| 5,077,771 | 12/1991 | Skillicorn et al. | 378/102 |
| 5,123,038 | 6/1992 | Negle et al. | 378/101 |
| 5,155,754 | 10/1992 | Ebersberger et al. | 378/105 |

FOREIGN PATENT DOCUMENTS

| | | |
|---|---|---|
| 0074141 | 3/1983 | European Pat. Off. . |
| 0080691 | 6/1983 | European Pat. Off. . |
| 0416708 | 3/1991 | European Pat. Off. . |
| 0487767 | 6/1992 | European Pat. Off. . |
| 2053606 | 3/1972 | Germany . |
| 3343130 | 7/1985 | Germany . |
| 1357395 | 6/1974 | United Kingdom . |
| 2049320 | 12/1980 | United Kingdom . |

*Primary Examiner*—Constantine Hannaher
*Assistant Examiner*—Don Wong
*Attorney, Agent, or Firm*—Cushman Darby & Cushman

[57] ABSTRACT

This invention aims at providing an X-ray apparatus having a stable X-ray output. Since the focus electrode of the X-ray tube of the X-ray apparatus according to this invention maintains a ground potential, the focus diameter of electrons bombarded against a target becomes constant. Hence, the X-ray output emerging from an exit window is stabilized. Since the potential ratio of a cathode to the target is always constant, the electric field distribution between the cathode and the target is stabilized, thereby stabilizing the X-ray output emerging from the exit window.

10 Claims, 24 Drawing Sheets

HEATER VOLTAGE CIRCUIT

X-RAY APPARATUS

BACKGROUND OF THE INVENTION

1. Field of the Invention

The present invention relates to an X-ray apparatus incorporating an X-ray tube. Related Background Art Conventionally, X-ray apparatuses such as those disclosed in U.S. Pat. Nos. 5,077,771, 4,646,338, and 4,694,480 are known. Those conventional apparatuses comprise an X-ray tube, a molded high-voltage power supply, and a molded control circuit.

To apply a voltage to the X-ray tube of this X-ray apparatus, a cathode ground voltage, a target ground voltage, or a focus voltage is variably applied to the X-ray tube. However, none of these schemes is suitable for a method of generating and controlling a microfocus X-ray which is the most important subject matter of a microfocus X-ray apparatus.

It is an object of the present invention to solve this problem.

SUMMARY OF THE INVENTION

According to the present invention, there is provided an X-ray apparatus comprising an X-ray tube and a control circuit, wherein the X-ray tube has a cathode for emitting electrons when heated by a heater, a target for generating X-rays upon bombarding the electrons emitted from the cathode, and a ground-potential focus electrode for focusing the electrons emitted from the cathode so that the electrons are bombard against the target, and the control circuit performs a control operation such that a voltage to be applied to the target and a voltage to be applied to the cathode are changed at a predetermined ratio in an interlocked manner.

With this arrangement, the focus electrode maintains the ground potential and will not vary. Hence, the focus diameter of the electrons bombarded against the target becomes constant, and the X-ray output radiated from the target is stabilized. The voltage applied to the cathode and the voltage applied to the target are changed by the control operation of the control circuit at a predetermined ratio in an interlocked manner. Thus, a potential difference between the cathode and the target remains constant, and the electric field distribution between the cathode and the target will not be disturbed.

The X-ray tube may also have a conductive envelope in which the cathode, the target, and the focus electrode are arranged, that envelope having an exit window through which the X-rays generated by the target emerge to the outside. In this case, since the envelope maintains the ground potential, the electric field distribution between the cathode and target will be rarely influenced and disturbed by the outside. Therefore, the X-ray output will not vary due to the disturbance in electric field distribution between the cathode and the target.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

DESCRIPTION OF THE PREFERRED EMBODIMENT

An embodiment of the present invention will be described with reference to the accompanying drawings.

Figure 1:
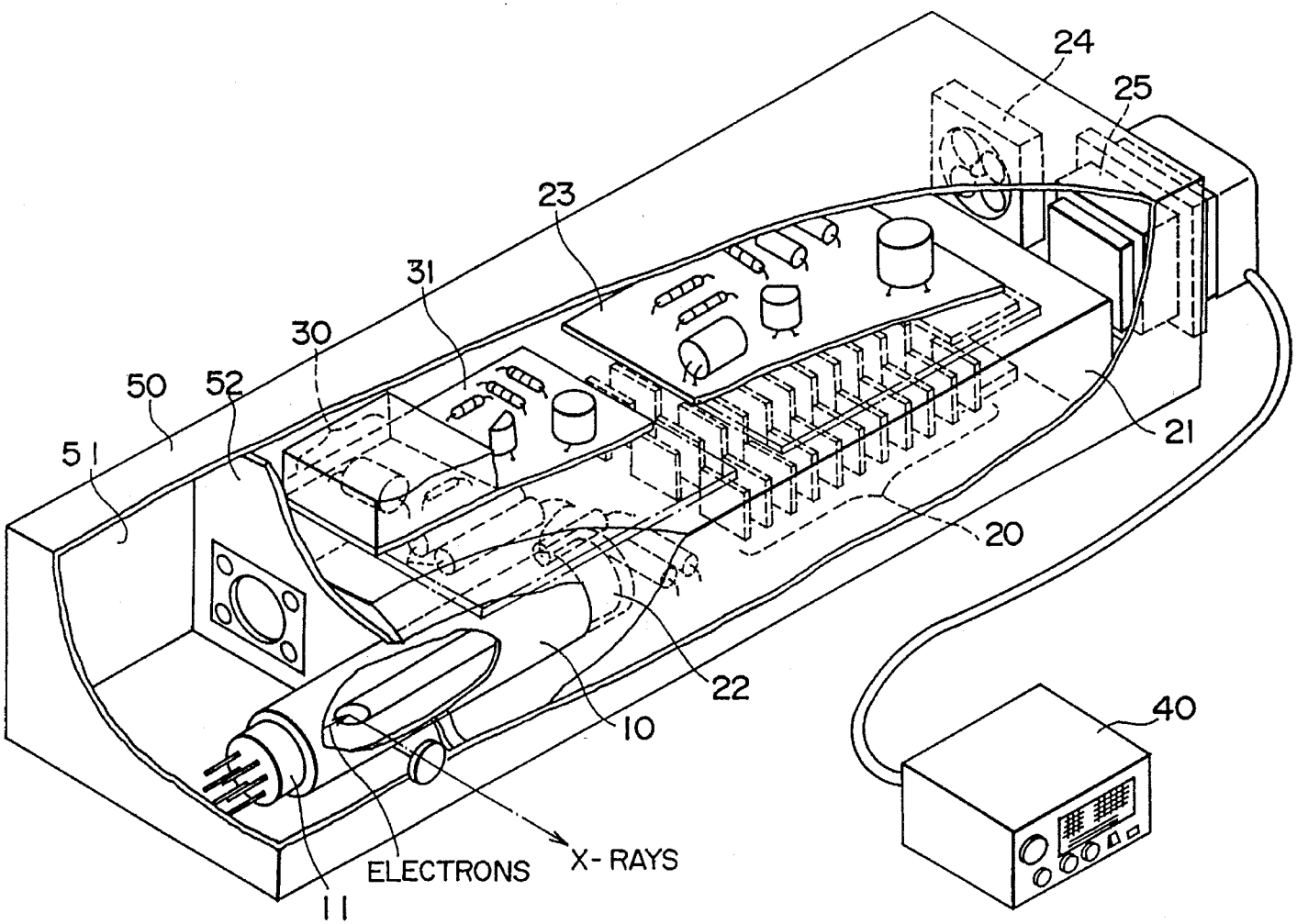
FIG. 1 is a perspective view showing the arrangement of an X-ray apparatus according to an embodiment of the present invention.
Figure 2:
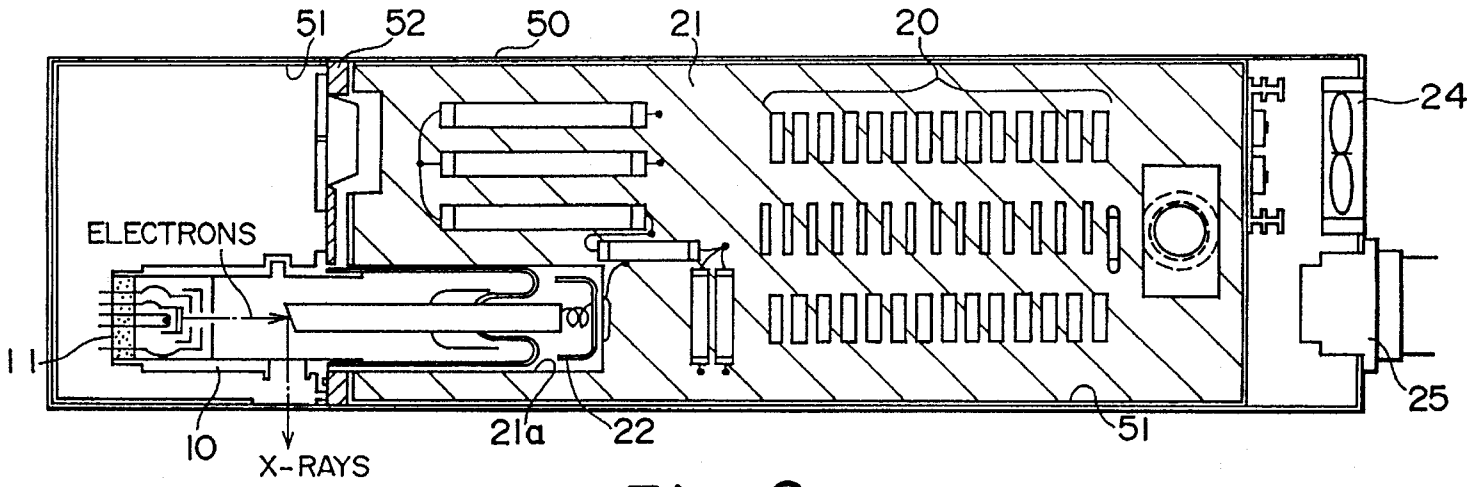
FIG. 2 is a sectional plan view showing the arrangement of the X-ray apparatus of this embodiment.
Figure 3:
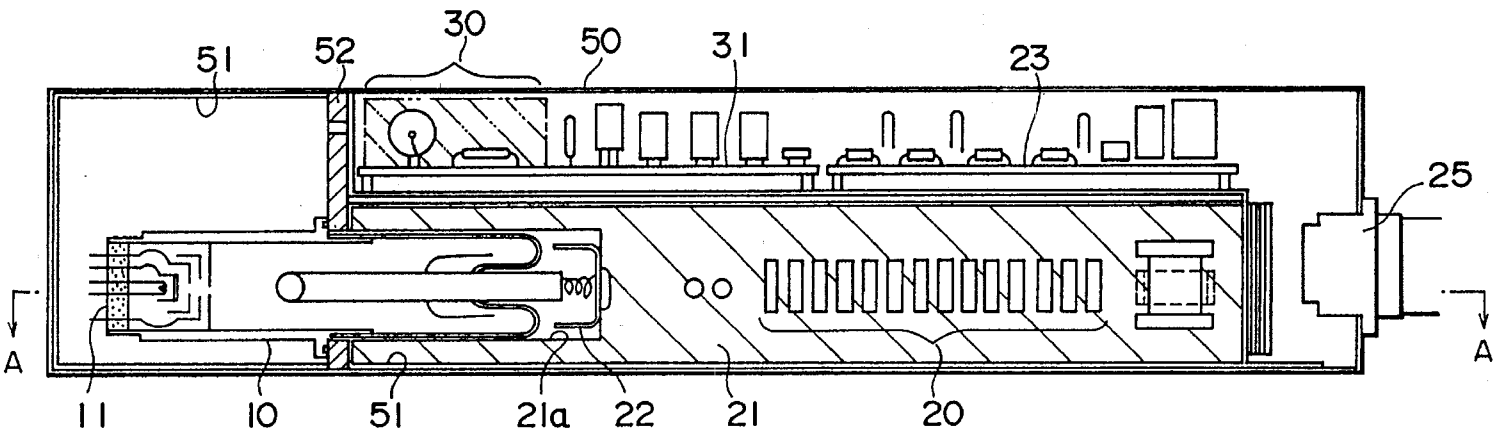
FIG. 3 is a sectional side view showing the arrangement of the X-ray apparatus of this embodiment.

FIG. 1 is a perspective view showing the arrangement of an X-ray apparatus according to this embodiment, and FIGS. 2 and 3 are sectional views showing the arrangement of the X-ray apparatus according to this embodiment. Referring to FIGS. 1 to 3, the X-ray apparatus of this embodiment has a microfocus X-ray tube 10 for radiating X-rays, Cockcroft circuits 20 and 30 for applying a high voltage to the microfocus X-ray tube 10, and a control unit 40 incorporating a control circuit for, e.g., controlling application of the voltage to the microfocus X-ray tube 10.

The microfocus X-ray tube 10 and the Cockcroft circuits 20 and 30 are built into a box 50 to which X-ray leakage prevention is performed with a lead plate 51. The control unit 40 is provided outside the box 50.

The Cockcroft circuit 20 is molded by a rectangular parallelepiped mold block 21. The microfocus X-ray tube 10 is attached to an insulating oil tank 21*a* provided to the side surface of the front portion of the mold block 21. A high-voltage power generated by the Cockcroft circuit 20 is supplied to the microfocus X-ray tube 10 through a target high-voltage supply terminal 22.

A board 23 having an inverter circuit for the Cockcroft circuit 20, and a board 31 having the Cockcroft circuit 30 are provided on the mold block 21. The Cockcroft circuit 30 is molded with a silicone resin, and the high-voltage power generated by the Cockcroft circuit 30 is supplied to the microfocus X-ray tube 10 through a stem 11.

A cooling fan 24 and a connector 25 for connecting the control unit 40 through a cable are provided at the side surface of the rear portion of the box 50. The cooling fan 24 cools transistors ($Q_1$ and $Q_2$) provided to the side surface of the rear portion of the mold block 21.

Figure 4:
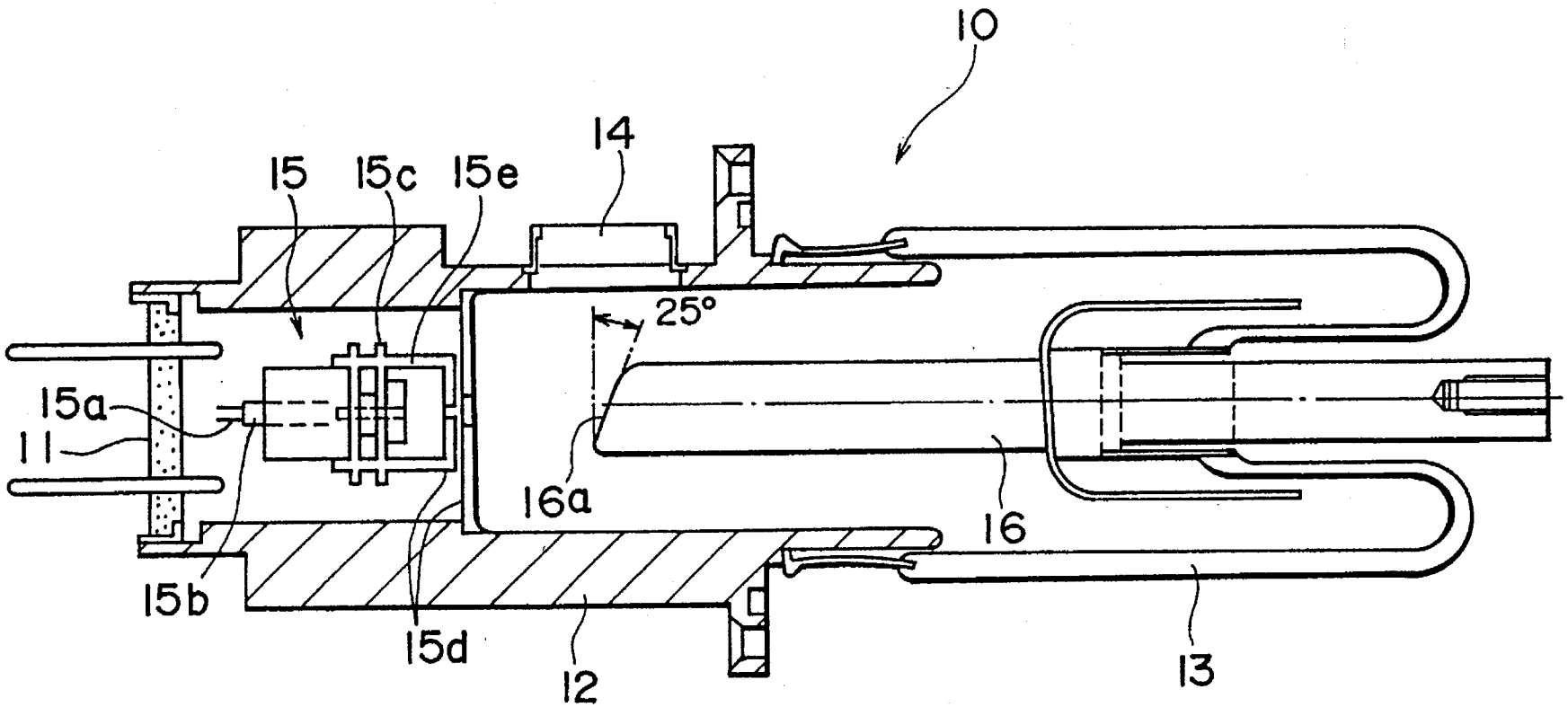
FIG. 4 is a sectional view showing the structure of a side window type microfocus X-ray tube.
Figure 5:
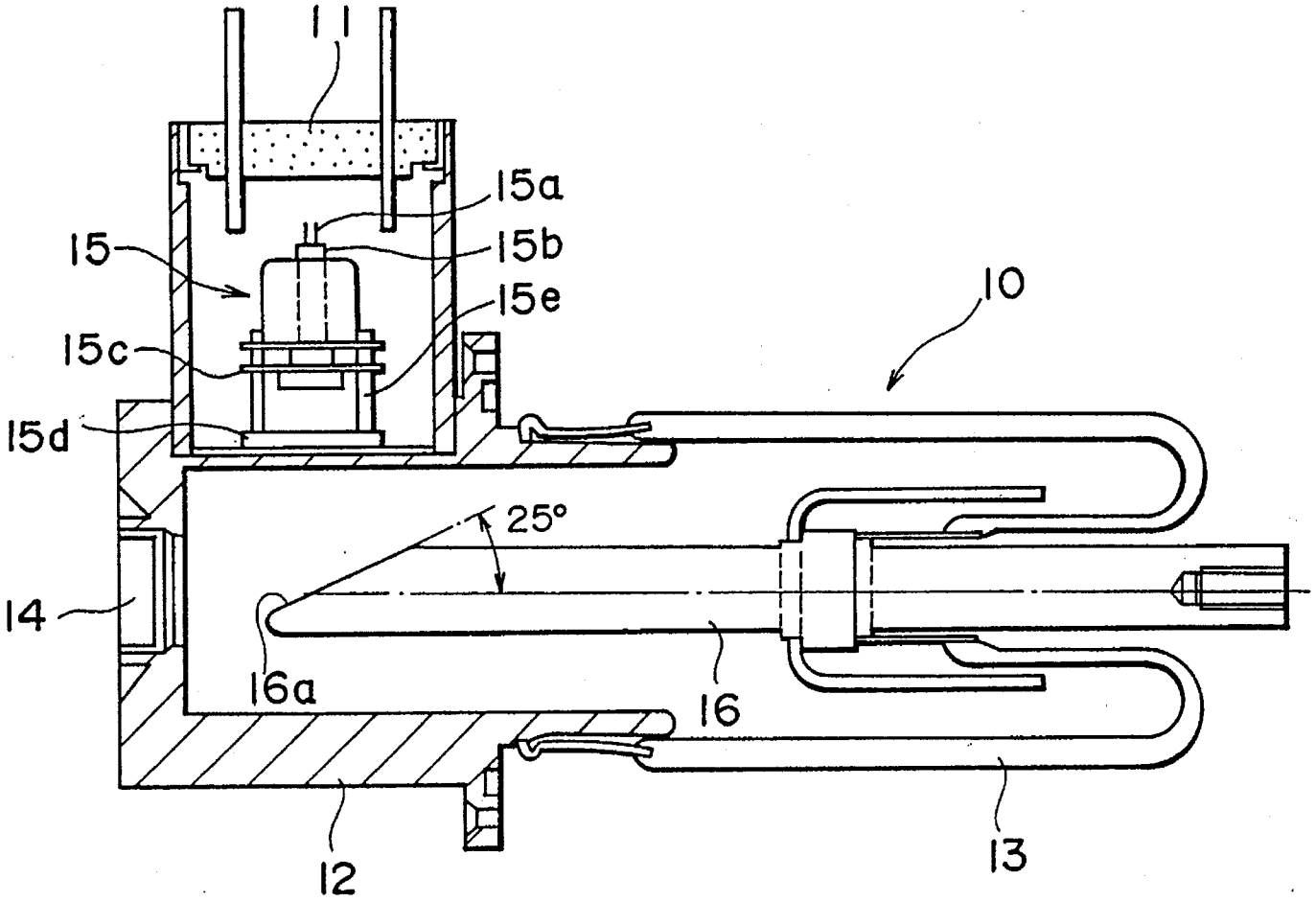
FIG. 5 is a sectional view showing the structure of an end window type microfocus X-ray tube.

The microfocus X-ray tube 10 is available as a side window type shown in FIG. 4 or an end window type shown in FIG. 5. Referring to FIGS. 4 and 5, the microfocus X-ray tube 10 is constituted by combining a metal envelope 12 and a glass envelope 13. The ceramic stem 11 is fitted in one end of the envelope 12, and a beryllium X-ray exit window 14 is formed in the side surface of the envelope 12.

Regarding the interiors of the envelopes 12 and 13, an electron gun 15 is arranged in the envelope 12, and an oxygen-free copper target base 16 is arranged in the envelope 13. The electron gun 15 is constituted by a heater electrode 15*a*, a cathode 15*b*, a grid electrode 15*c*, and a focus electrode 15*d*. A tungsten target 16*a* is brazed to the distal end of the target base 16 with silver.

When the cathode 15*b* is heated by the heater electrode 15*a*, electrons are emitted from the surface of the cathode 15*b* at a predetermined temperature. The emitted electrons are accelerated by the grid electrode 15*c* and focused by the focus electrode 15*d* to bombard the target 16*a*. By this bombardment, the electrons are transformed into X-rays and heat, and the generated X-rays emerge to the outside through the X-ray exit window 14. The generated heat is dissipated to the outside through the target base 16 having a high heat conductivity.

The target 16*a* is arranged with an inclination of 25° with respect to a plane perpendicular to the track of the electrons flowing toward the target 16*a*. Since the target 16*a* is inclined in this manner, most of the generated X-rays reach the X-ray exit window 14 and emerge to the outside through the X-ray exit window 14.

Figure 6:
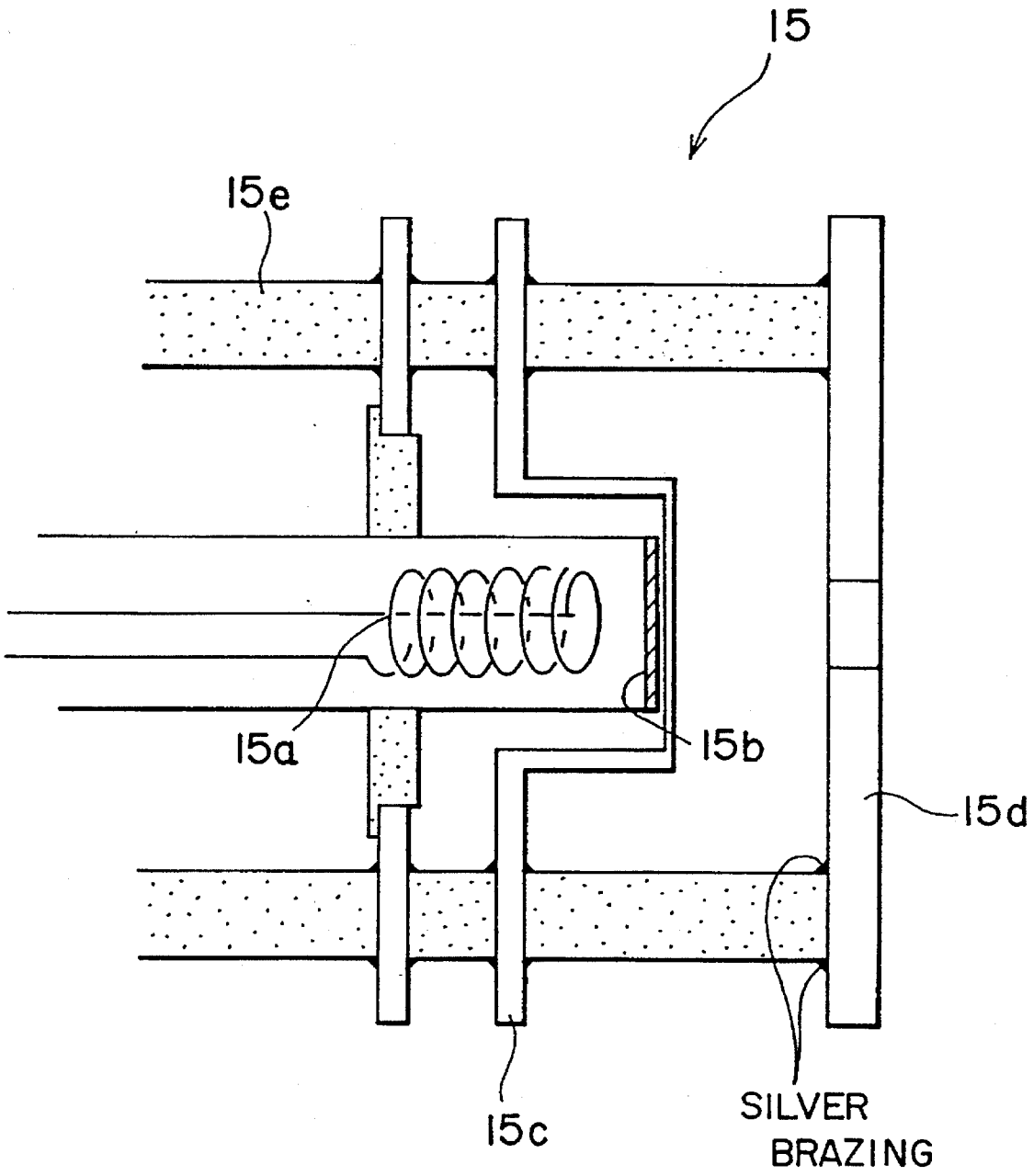
FIG. 6 is a sectional view showing the structure of an electron gun.

FIG. 6 is a sectional view showing the structure of the electron gun 15. Referring to FIG. 6, the heater electrode 15*a*, the cathode 15*b*, the grid electrode 15*c*, and the focus electrode 15*d* are attached to alumina or sapphire pillars 15*e*. Molybdenum (Mo) having an excellent heat resistance and excellent heat dissipation properties is used as the material of the grid electrode 15*c* and focus electrode 15*d*. The grid electrode 15*c* and focus electrode 15*d* are adhered to the piliars 15*e* by brazing using amorphous glass or silver. Since amorphous glass has a lower processing temperature than that of silver, electrodes and the like are less deformed by processing when amorphous glass is used, thereby forming the electron gun 15 with a high precision.

An impregnated cathode is used as the cathode 15*b*. An impregnated cathode is obtained by impregnating porous tungsten with BaO, CaO, and $Al_2O_3$, and its electron radiation surface is covered with Os (Osmium), Ir (Iridium), Os/Ru (Ruthenium), or the like. This coating can decrease the operation temperature by 100° C. Thus, the service life of the cathode 15*b* is prolonged.

A nickel-copper alloy is used as the material of the envelope 12. The nickel-copper alloy is a metal which has a high thermal conductivity and workability (especially weldability) and which discharges a small amount of gas. Especially, since the nickel-copper alloy has a high thermal conductivity, it can quickly remove heat generated in the microfocus x-ray tube 10 to the outside. Thus, damage to the microfocus x-ray tube 10 caused by the heat can be decreased, thereby prolonging the service life.

The envelope 12 has an electrical conductivity and always maintains a ground potential. Since the focus electrode 15*d* is connected to the envelope 12, the focus electrode 15*d* also always maintains the ground potential. Hence, even if the potential of the target 16*a* is changed, the shape of the electron lens formed around the focus electrode 15*d* is always constant to maintain stable X-ray microfocus. In addition, since the electron gun 15 and the target 16*a* are surrounded by the envelope 12 having the ground potential, the electric field in the envelope 12 will not be disturbed due to the influence of the outside of the envelope 12.

Figure 7:
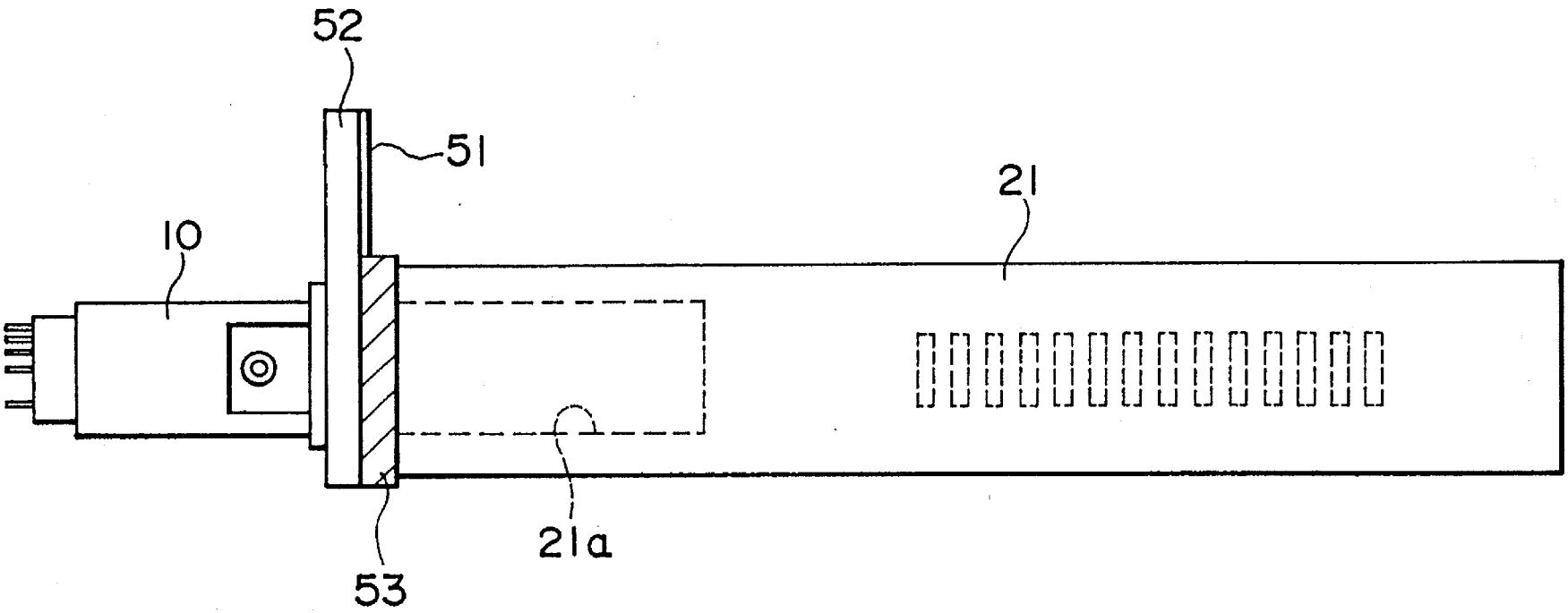
FIG. 7 is a sectional view showing a state wherein a microfocus X-ray tube and a mold block are fixed to a panel.

FIG. 7 is a sectional view showing a state wherein the microfocus X-ray tube 10 and the mold block 21 are fixed to a panel 52. Referring to FIG. 7, the lead plate 51 for X-ray shield is adhered to the surface of the panel 52 on the mold block 21 side. The microfocus X-ray tube 10 is inserted in the insulating oil tank 21*a* of the mold block 21, and a high-pressure insulating oil for the purpose of insulation is sealed between the insulating oil tank 21*a* and the microfocus X-ray tube 10. The mold block 21 is fixed to the panel 52 by adhesion, and part of the microfocus X-ray tube 10 inserted in the mold block 21 projects from a surface of the panel 52 opposite to the surface to which the mold block 21 is adhered. The mold block 21 is fixed to the panel 52 by adhesion because the panel 52 and the mold block 21 cannot be integrally formed as they are made of different materials.

Part of the high-pressure insulating oil sealed in the insulating oil tank 21*a* of the mold block 21 evaporates due to heat generated upon X-ray generation. Especially, when a silicone-based adhesive having excellent heat characteristics is used to adhere the panel 52, the lead plate 51, and the mold block 21, almost 90% the evaporation amount of the whole insulating oil evaporates from this adhesive layer. When the insulating oil evaporates, the insulting oil stored in the mold block 21 decreases. The proportion of decrease is as high as about 6% the stock amount when the X-ray apparatus is used throughout the year (8,760 hours). Due to this evaporation, a hollow space is formed in the insulating oil tank 21*a*, and the insulating oil tends to contact air. Then, the proportion of oxidized insulating oil is increased to decrease the dielectric strength. When evaporation of the insulating oil further proceeds, the surface of the microfocus X-ray tube 10 is exposed to the air, thereby causing a dielectric failure.

Therefore, according to this embodiment, a peripheral portion of the adhesive layer of the panel 52 and the mold block 21 to which the microfocus X-ray tube 10 is adhered, or the entire adhesive layer is covered with an evaporation preventive cover 53 to prevent evaporation of the insulating oil. For example, when an epoxy resin is used as the material of the evaporation preventive cover 53, the evaporation amount can be decreased to 3% or less. Then, the service life of the insulating oil is prolonged, so that a stable operation can be continued.

Figure 8:
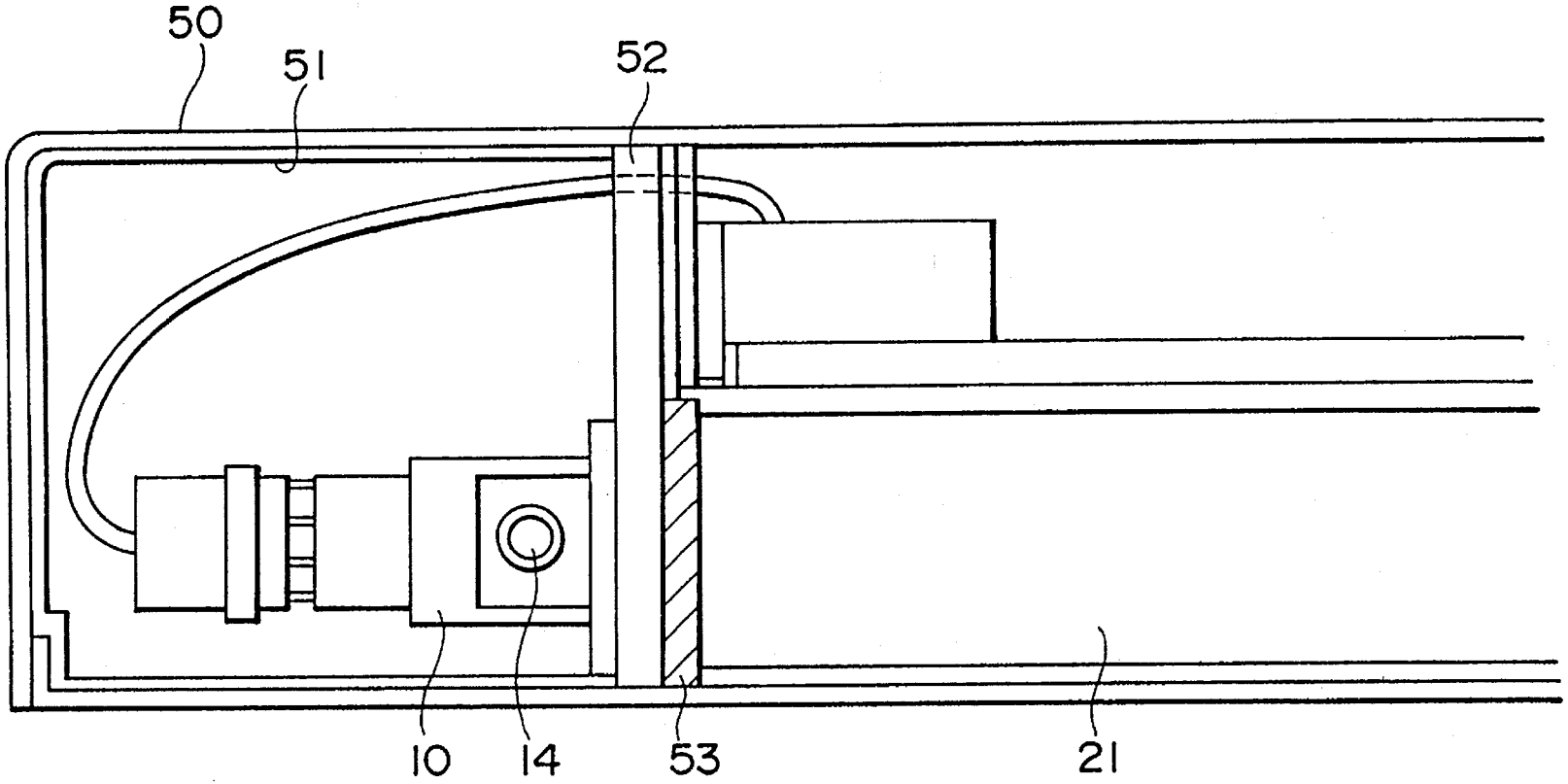
FIG. 8 is a sectional view showing the structure of an X-ray exit portion.

FIG. 8 is a sectional view showing the structure of the X-ray exit portion of the X-ray apparatus of this embodiment. The leaking X-ray shielding function of the X-ray apparatus of this embodiment will be described with reference to FIG. 8. Due to the structure of the microfocus X-ray tube 10, the X-rays generated by the target 16*a* are emitted in a direction other than toward the X-ray exit window 14 as well to form leaking X-rays. When these X-rays leak to the outside, they adversely influence the peripheral equipment to cause a problem in maintenance.

In this embodiment, most of the leaking X-rays are shielded by the box 50 and the lead plate 51 provided on the inner surface of the box 50. More specifically, a metal, e.g., iron, having a thickness of about 1 to 2 mm is used to form the box 50, thereby shielding 86% the X-rays emitted with an energy of a tube voltage of about 70 kV. Furthermore, almost 100% the X-rays can be shielded by the lead plate 51.

When the X-rays are emitted with an energy of a tube voltage of about 70 kV, a lead plate having a thickness of about 1 to 2 mm can sufficiently shield the X-rays. Then, the radiant quantities of the X-rays radiated to the outside through the lead plate 51 and the box 50 become 1 μSV/hr or less. Since 1 μSV/hr is equal to or less than the reference X-ray quantities regulated by the ionizing radiation trouble prevention code, the X-ray apparatus of this embodiment is an apparatus having a high safety.

Figure 9:
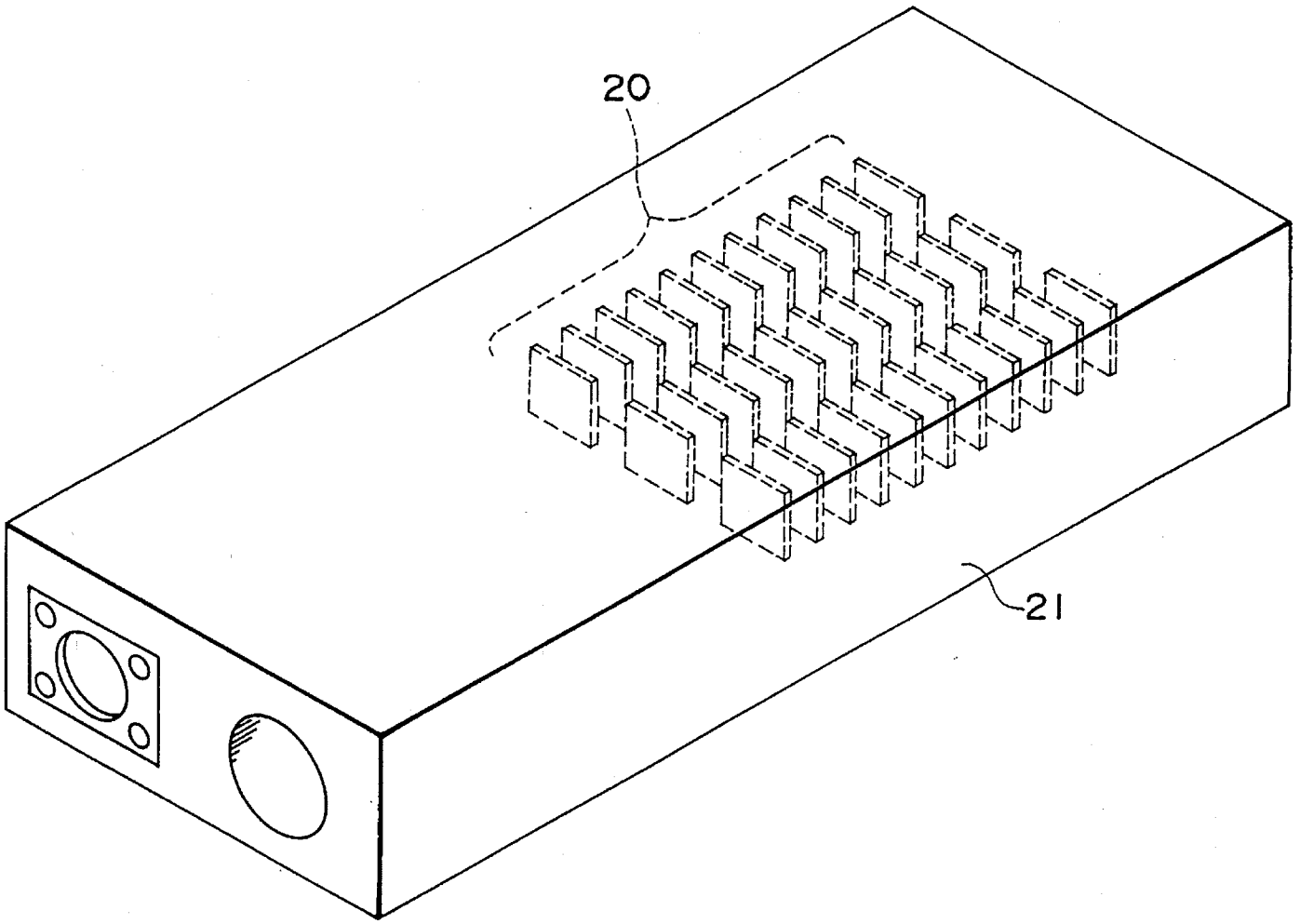
FIG. 9 is a perspective view showing the exterior of the mold block.

FIG. 9 is a perspective view showing the outer appearance of the mold block 21. The Cockcroft circuit 20 is buried in the mold block 21 shown in FIG. 9. The Cockcroft circuit 20 is a circuit which is often used when manufacturing a high-voltage power supply apparatus of about 70 kV. When the voltage is as high as about 70 kV, the Cockcroft circuit 20 must be molded with an insulating material so that a portion of the Cockcroft circuit 20 whose voltage is increased to a particularly high voltage will not be influenced by the surrounding atmosphere. For this purpose, the Cockcroft circuit 20 is molded by using the mold block 21.

In general molding, a circuit group is placed in a die and an insulating material is flowed, thereby forming a mold block. Since the insulating material to be flowed into the die tends to be easily cured by heat, if the block has a complicated shape, sometimes bubbles remain in the block. When bubbles remain in the mold block in this manner, a dielectric failure occurs.

Figure 10:
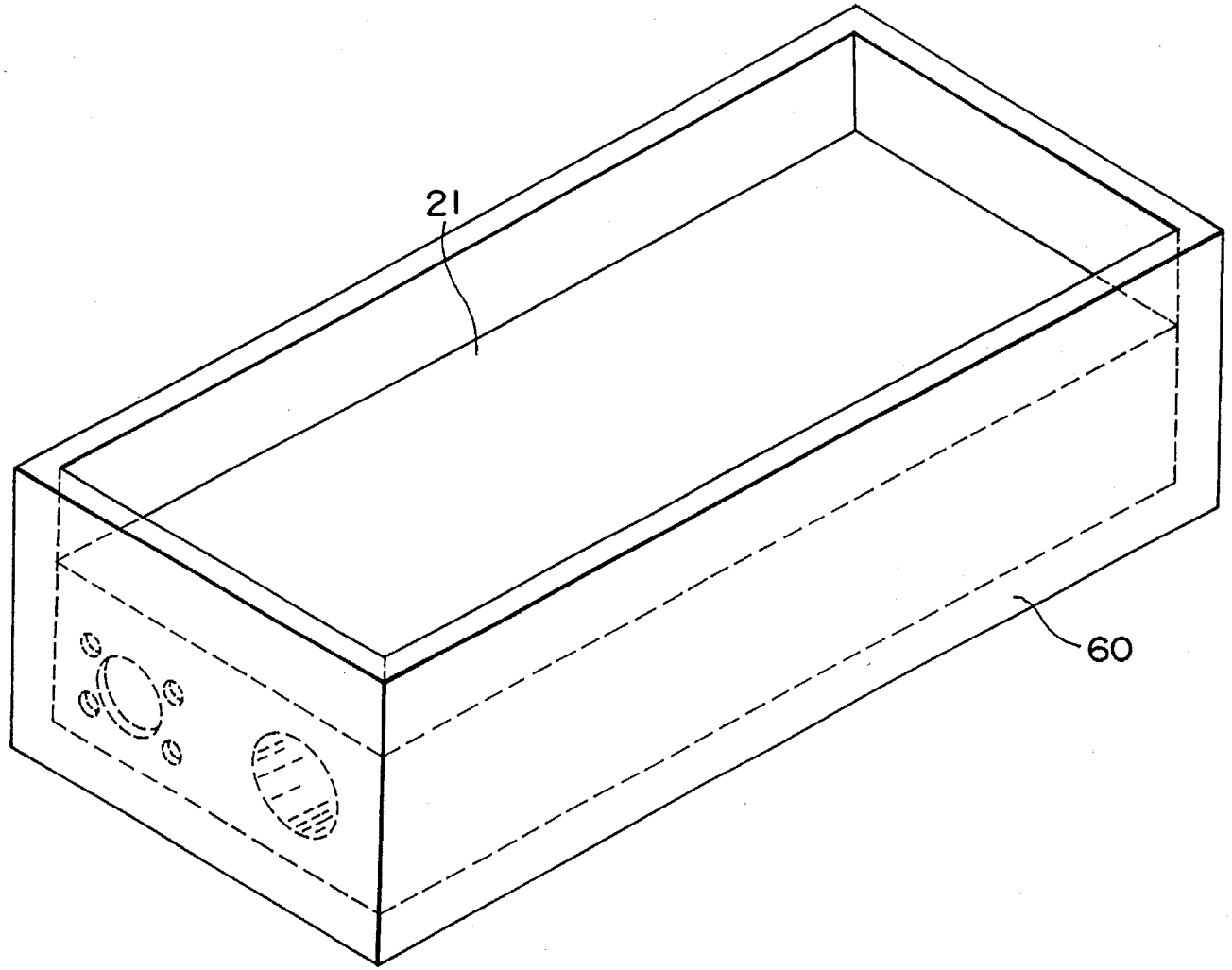
FIG. 10 is a perspective view showing the exterior of a molding die.

In this embodiment, since the rectangular parallelepiped mold block 21 having a simple shape is used, bubbles will not substantially remain in the block. Also, in the manufacturing process of the mold block 21, the following countermeasure is taken. The mold block 21 is formed by flowing an insulating material in a molding die 60 having a structure shown in FIG. 10. As the upper opening of the molding die 60 is not covered with a lid-like member, the bubbles generated during formation of the mold block 21 can easily escape through the upper opening. Furthermore, when the molding die 60 is to be formed, it can be formed very easily unlike, e.g., a molding die having a cylindrical shape.

As the most important factor in the microfocus X-ray tube 10, even if the cathode voltage or target voltage is changed, the focus diameter of the microfocus X-ray tube 10 should not be influenced by this change and stays small without being changed. In this embodiment, the cathode voltage is changed interlocked with a change in target voltage by the control operation of the control unit 40. Therefore, the ratio of the cathode voltage to the target voltage becomes constant, and the focus diameter of the electrons bombarded against the target 16*a* is always constant without being influenced by a change in target voltage. When the ratio of the cathode voltage to the target voltage is 1:100, even if the target voltage is changed from +20 kV to +70 kV, the focus diameter is maintained to be constant, thereby minimizing the focus diameter.

Regarding the electric field distribution between the focus and target, which is formed by the focus electrode 15*d*, the target 16*a*, and the envelope 12 surrounding the focus electrode 15*d* and the target 16*a*, the material of the envelope 12 has a great importance. When the envelope 12 is constituted by an insulating material, the electric field distribution is disturbed by the charge-up which is caused by a change in target voltage and focus voltage. Therefore, in this embodiment, the metal envelope 12 having a ground potential is used, and the focus electrode 15*d* is connected to the envelope 12 and set to the same potential as that of the envelope 12, thereby preventing a disturbance in electric field distribution in the envelope 12. Furthermore, as the outer surface of the mold block of the Cockcroft circuits 20 and 30 is in contact with the envelope 12, it can be maintained at the ground potential, thereby minimizing a danger to the outside caused by the high voltage.

Figure 11:
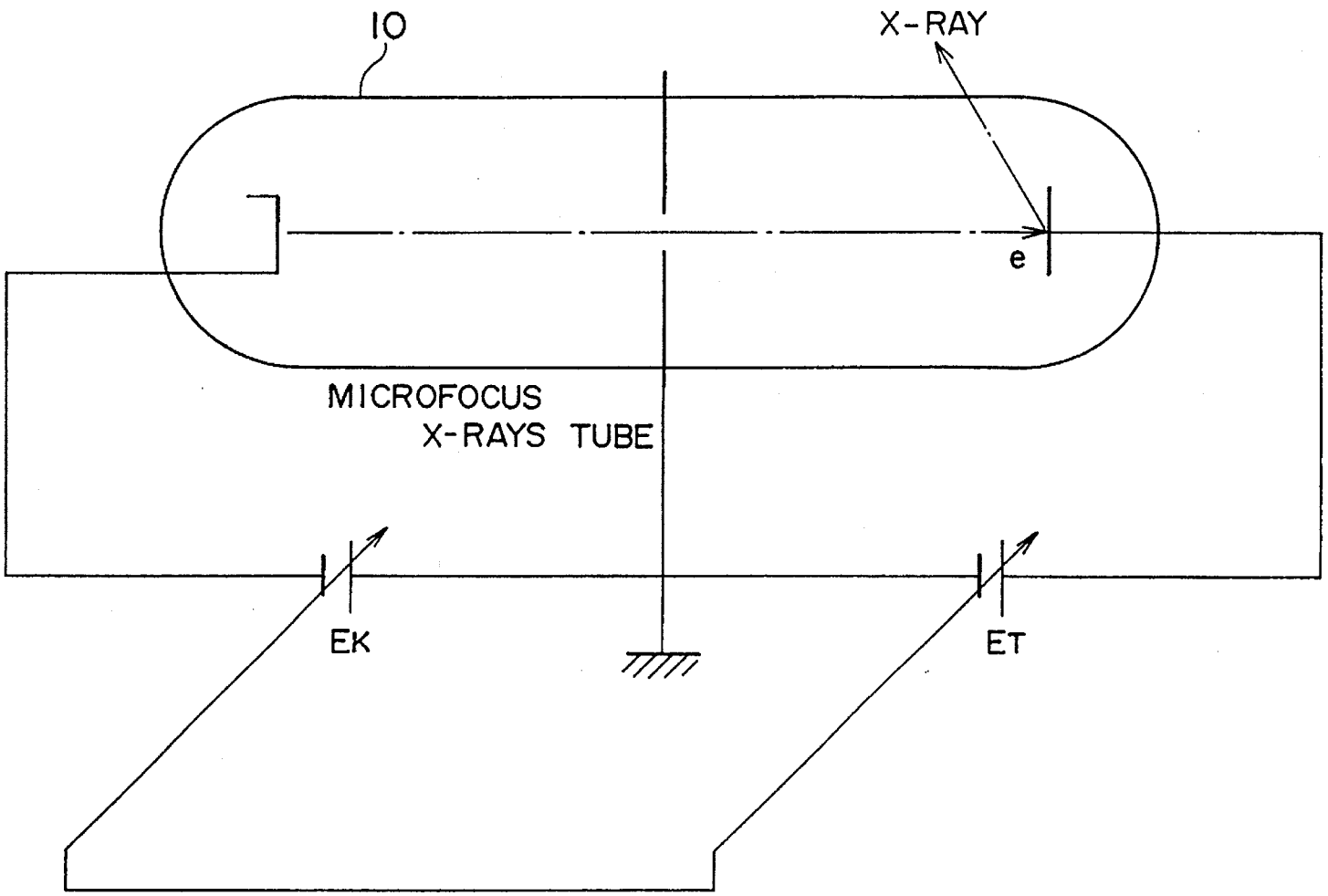
FIG. 11 is a schematic diagram of a circuit for interlocking a cathode voltage and a target voltage.

FIG. 11 is a schematic diagram of a circuit for setting the cathode voltage and the target voltage in an interlocked manner to maintain the focus diameter at a constant value. When a DC voltage of 0 to 7 V is applied to set the target voltage, the target voltage ($E_T$) changes from 0 to +70 kV. As the DC voltage of 0 to 7 V applied for setting the target voltage is simultaneously applied to the cathode control circuit as well, the cathode voltage ($E_K$) changes from 0 to −700 V. Therefore, the target voltage ($E_T$) and the cathode voltage ($E_K$) change in an interlocked manner to always maintain a constant ratio of 100:1. A voltage having a lower potential than the cathode voltage (EK) is applied to the grid electrode 15*c*, thereby controlling the target current.

Figure 12:
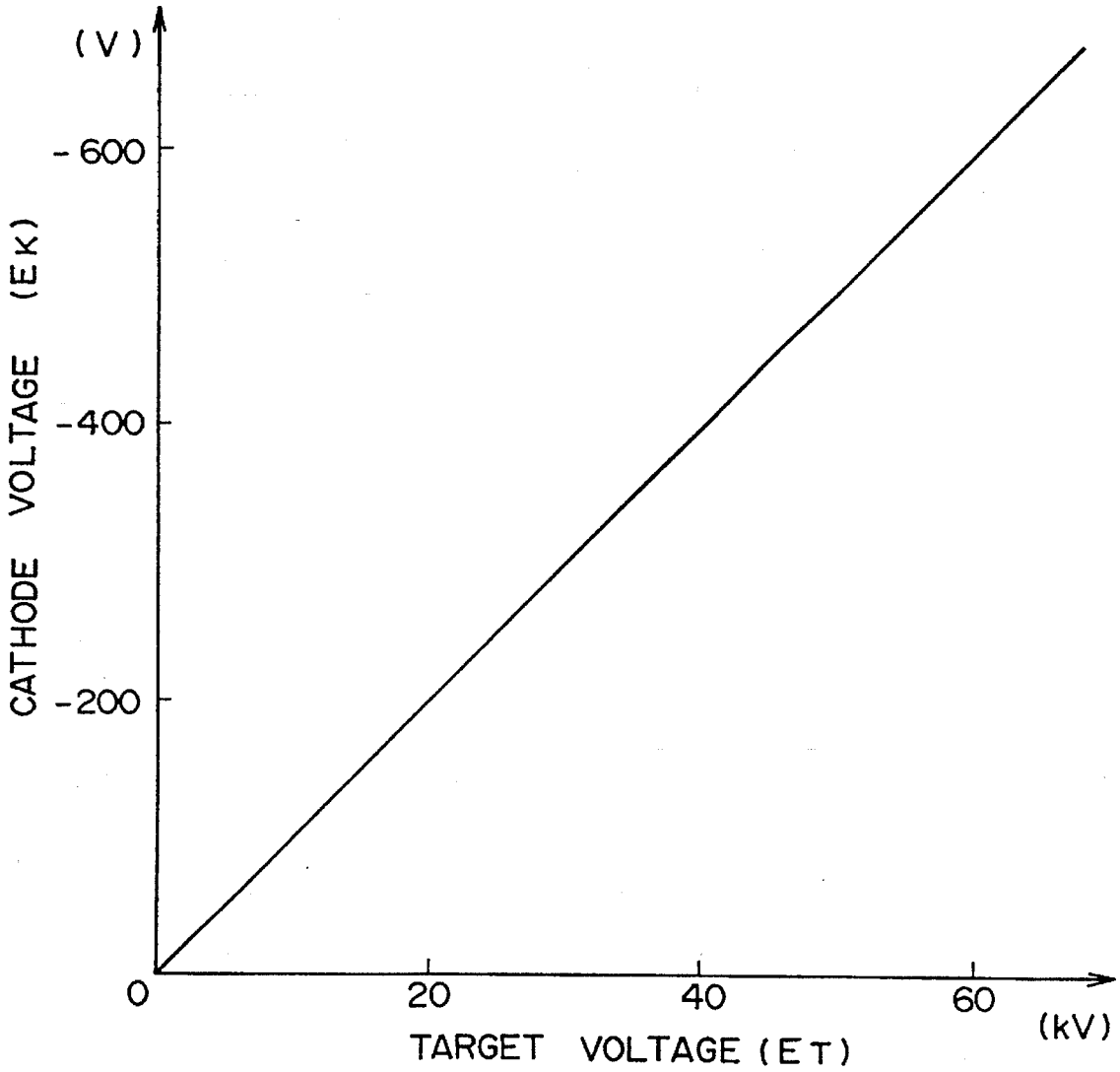
FIG. 12 is a graph showing the relationship between the target voltage and the cathode voltage.

When an X-ray apparatus sample according to this embodiment was manufactured and the relationship between the target voltage ($E_T$) and the cathode voltage ($V_K$) was measured, a proportional relationship as shown in FIG. 12 was obtained. With the X-ray apparatus having this relationship, the focus diameter of the electrons bombarded against the target 16*a* becomes constant, and the output of the radiated X-rays is stabilized.

Figure 13:
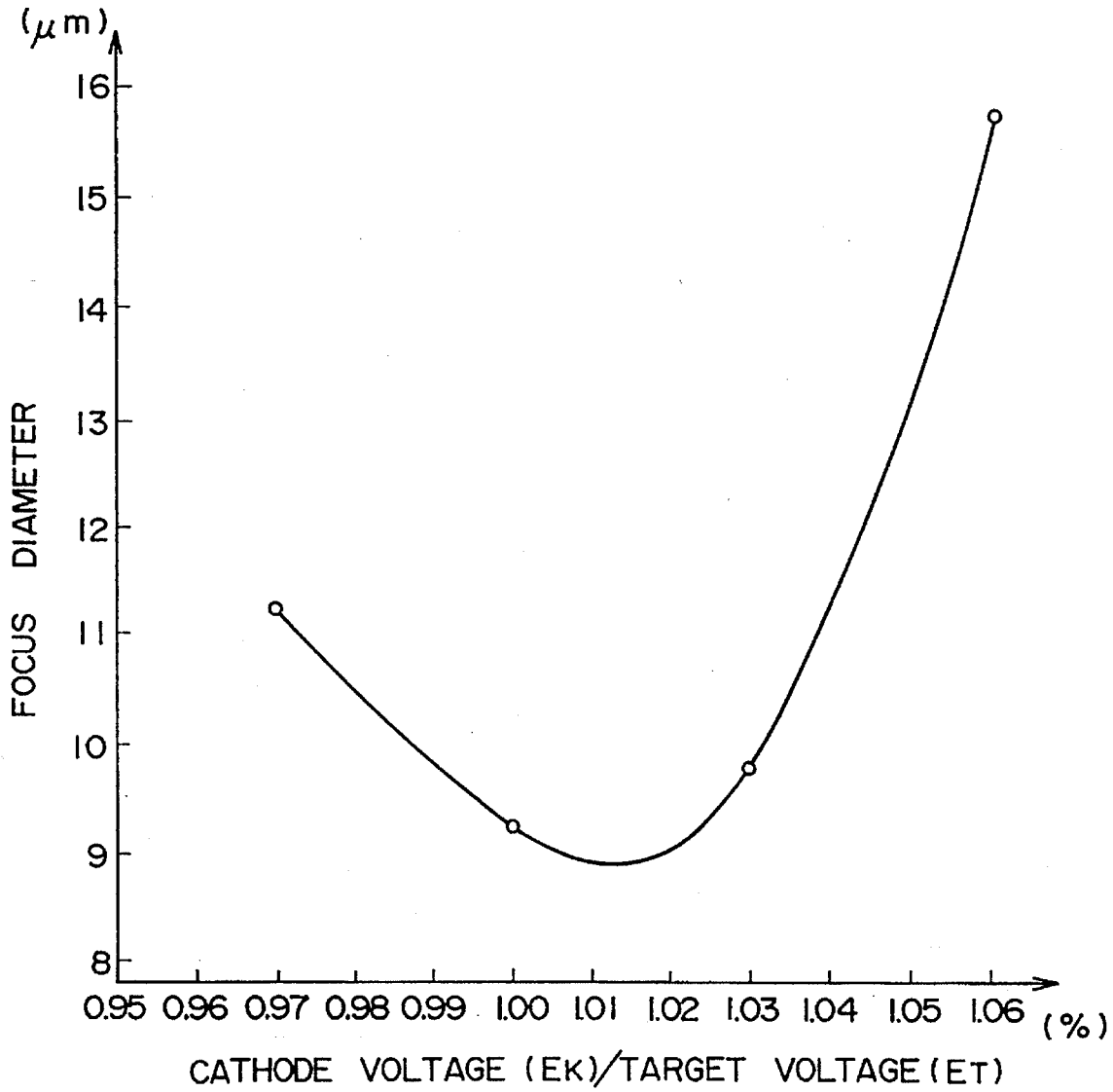
FIG. 13 is a graph showing the relationship between the ratio of the cathode voltage to the target voltage and the focus diameter of electrons bombarded against a target.

When another X-ray apparatus sample according to this embodiment was formed and the relationship between the ratio ($E_K/E_T$) of the cathode voltage ($E_K$) to the target voltage ($E_T$) and the focus diameter of the electrons bombarded against the target 16*a* was measured, a relationship as shown in FIG. 13 was obtained. It is apparent from the graph of FIG. 13 that the focus diameter of the electrons becomes minimum when $E_K/E_T$ is about 1.01%.

Figure 14:
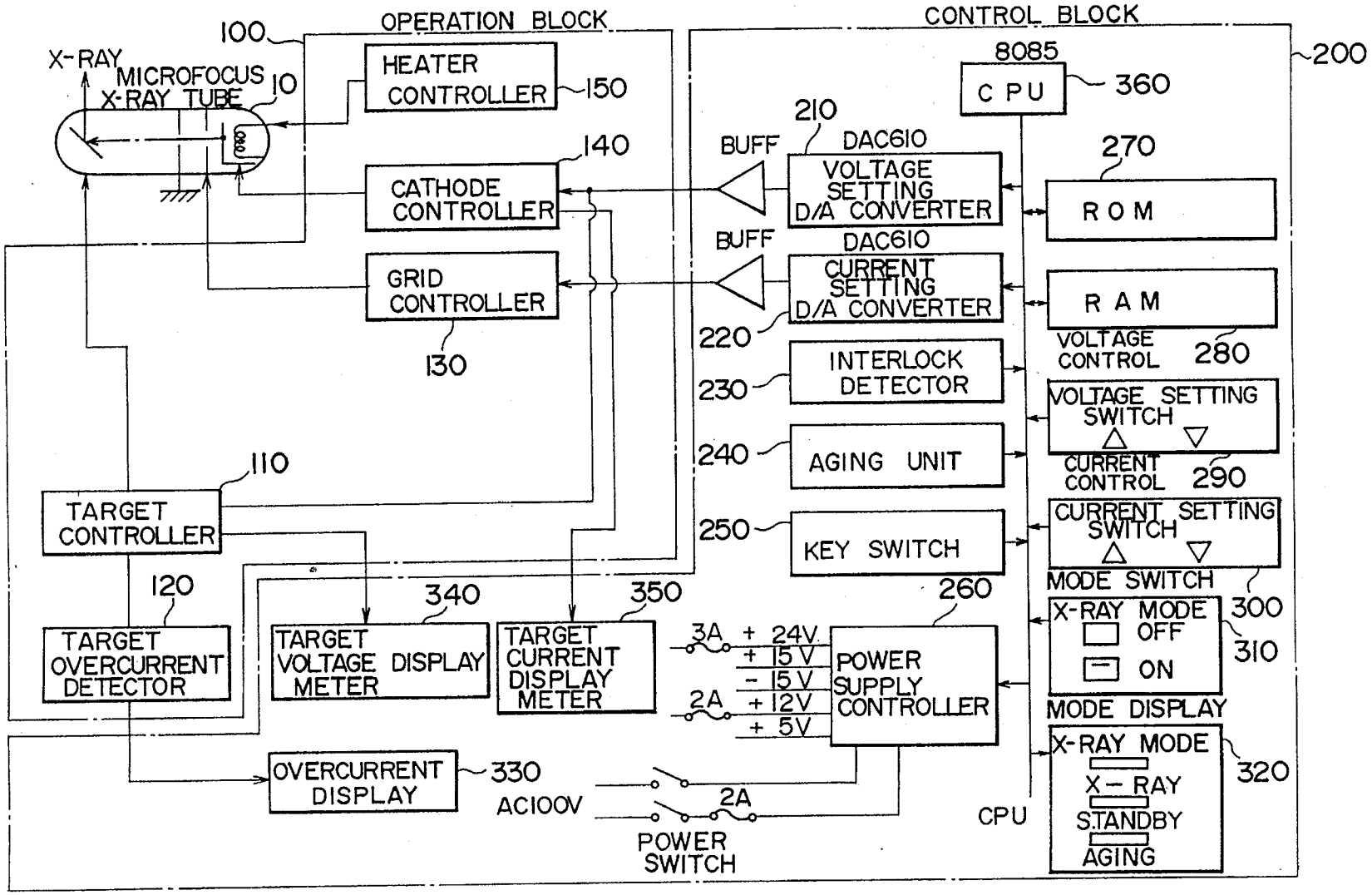
FIG. 14 is a block diagram showing the operation of the X-ray apparatus of this embodiment.

FIG. 14 is a block diagram showing the operation of the X-ray apparatus of this embodiment. This block diagram is divided into an operation block 100 for operating the microfocus X-ray tube 10 and a control block 200 for controlling the operation block 100.

The operation block 100 has a target controller 110 for controlling the target voltage of the microfocus X-ray tube 10, a target overcurrent detector 120 for detecting an overcurrent of the target 16*a*, and a grid controller 130 for controlling the grid voltage of the microfocus X-ray tube 10. The operation block 100 also has a cathode controller 140 for controlling the cathode voltage of the microfocus X-ray tube 10 and a heater controller 150 for controlling the heater voltage of the microfocus X-ray tube 10.

The control block 200 has a voltage setting D/A converter 210 for applying a target voltage setting voltage to the target controller 110 and the cathode controller 140, a current setting D/A converter 220 for applying a target current setting voltage to the grid controller 130, and an interlock detector 230 for detecting an interlock. The control block 200 also has an aging unit 240 for performing warm-up, a key switch 250 for stopping generation of the X-rays, and a power supply controller 260 for performing voltage conversion. The control block 200 also has a ROM 270 storing a control program, a RAM 280, a voltage setting switch 290 for setting a voltage, a current setting switch 300 for setting a current, and a mode switch 310 for setting an X-ray mode. The control block 200 also has a mode display 320 for displaying the X-ray mode, an overcurrent display 330 for displaying a target overcurrent, a target voltage display meter 340 for displaying a target voltage, a target current display meter 350 for displaying a target current, and a CPU 360 for controlling the respective units enumerated above.

Figure 15:
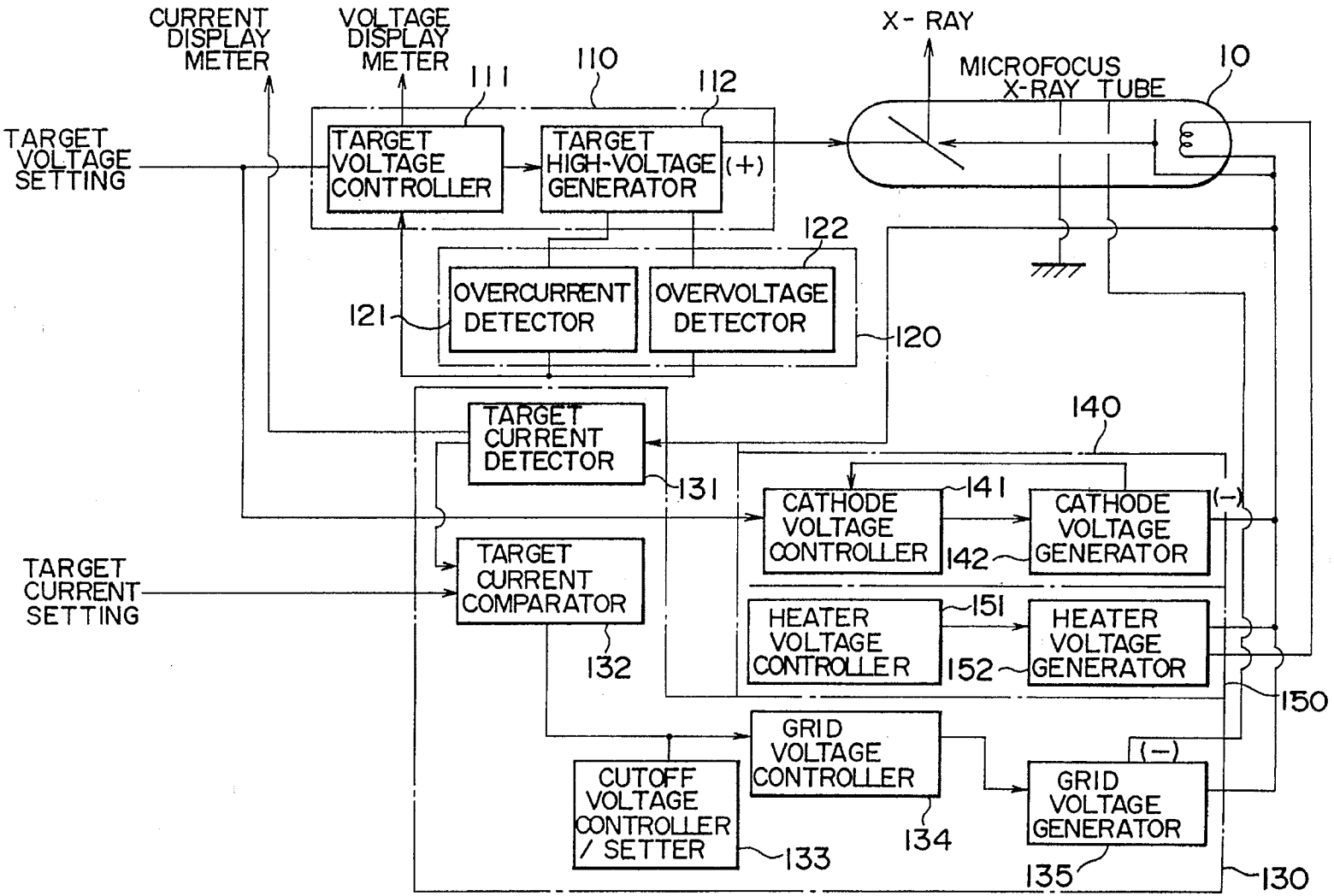
FIG. 15 is a block diagram showing the arrangement of an operation block in detail.

FIG. 15 is a block diagram showing the arrangement of the operation block 100 in detail. Referring to FIG. 15, the target controller 110 has a target voltage controller 111 for controlling the target voltage upon reception of the target voltage setting voltage from the voltage setting D/A converter 210, and a target high-voltage generator 112 for generating a desired target high-voltage upon reception of an instruction from the target voltage controller 111. The target overcurrent detector 120 has an overcurrent detector 121 for detecting an overcurrent state of the target current generated by the target high-voltage generator 112, and an overvoltage detector 122 for detecting an overvoltage state of the target voltage generated by the target high-voltage generator 112.

The grid controller 130 has a target current detector 131 for detecting the target current, a target current comparator 132 for comparing the target current detected by the target current detector 131 with a preset current signal output from the current setting D/A converter 220, and an cutoff voltage controller/setter 133. The grid controller 130 also has a grid voltage controller 134 for controlling the grid voltage based on the comparison result from the target current comparator 132, and a grid voltage generator 135 for generating a desired grid voltage upon reception of an instruction from the grid voltage controller 134.

The cathode controller 140 has a cathode voltage controller 141 for controlling the cathode voltage upon reception of a target voltage setting voltage from the voltage setting D/A converter 210, and a cathode voltage generator 142 for generating a desired cathode voltage upon reception of an instruction from the cathode voltage controller 141. The heater controller 150 has a heater voltage controller 151 for controlling the heater voltage, and a heater voltage generator 152 for generating a desired heater voltage upon reception of an instruction from the heater voltage controller 151.

FIGS. 16 to 24 are practical circuit diagrams of the respective circuits of the operation block 100 and the control block 200.

Figure 16:
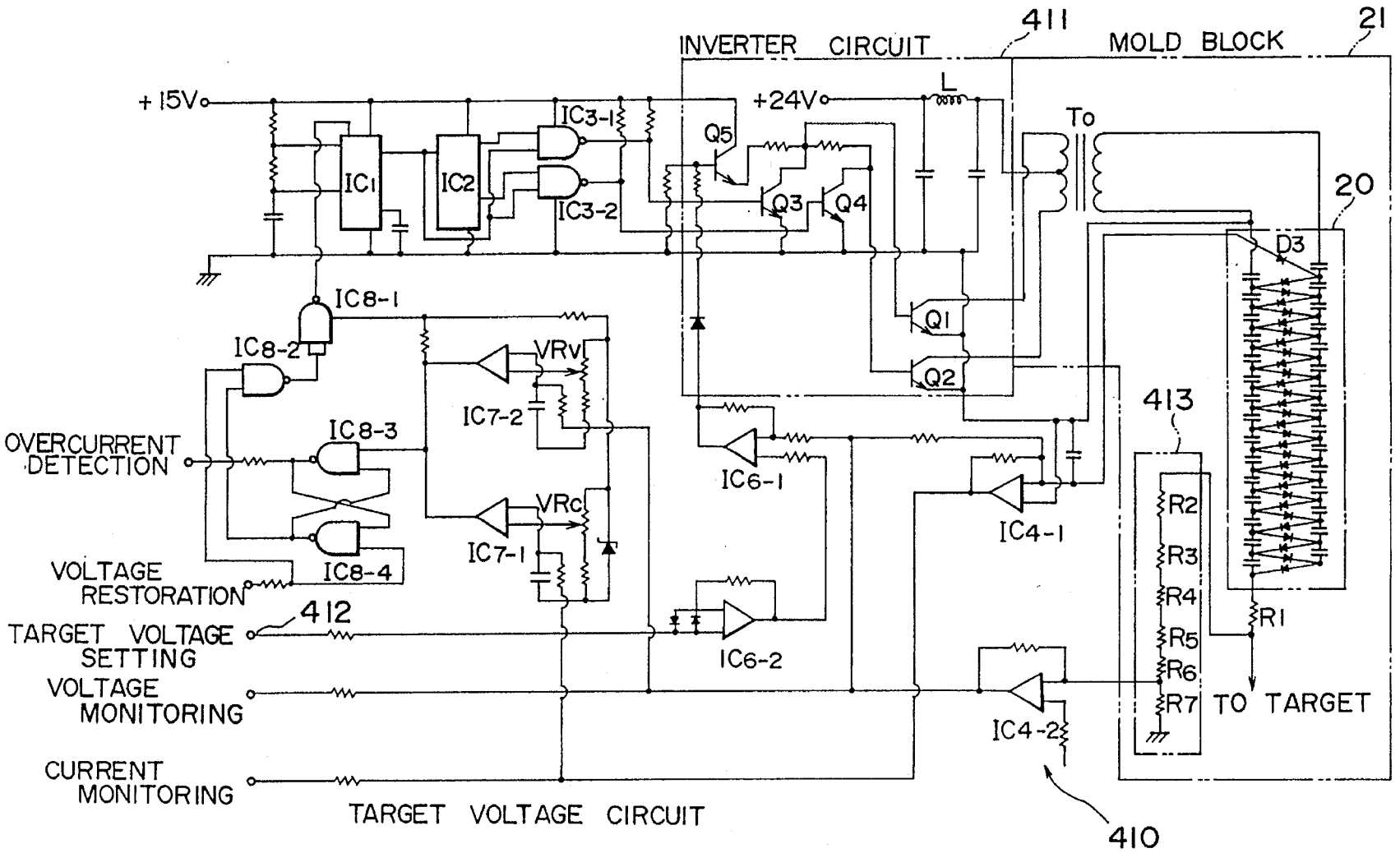
FIG. 16 is a circuit diagram showing the arrangement of a target voltage circuit.

FIG. 16 is a circuit diagram of the target controller 110. A target voltage circuit 410 shown in FIG. 16 comprises an inverter circuit 411 provided on the board 23, circuits in the mold block 21, and the like.

When a signal having a predetermined frequency and output from an oscillator $IC_1$ is supplied to an $IC_2$ and $IC_3$ ($IC_{3-1}$ and $IC_{3-2}$), push-pull switching is performed, and outputs from the $IC_2$ and $IC_3$ are supplied to a transformer $T_0$. When a target voltage setting voltage is applied from the voltage setting D/A converter 210 to a voltage setting terminal 412, the target voltage setting voltage is applied to transistors $Q_5$, $Q_3$, and $Q_4$ and the transistors $Q_1$ and $Q_2$ through $IC_6$ ($IC_{6-1}$ and $IC_{6-2}$), and a current flows across the two terminals of the primary winding of the transformer $T_0$. Since a voltage of 24 V is applied to the intermediate point of the transformer $T_0$, a voltage corresponding to a change in current output from the transistors $Q_1$ and $Q_2$ is applied across the transformer $T_O$.

A secondary voltage which is boosted with the turn ratio of the transformer $T_0$ is generated in the secondary winding of the transformer $T_0$. This secondary voltage has a value proportional to a change in voltage of the primary winding of the transformer $T_0$. The boosted voltage is voltage-amplified by the Cockcroft circuit 20, and a high voltage is generated at the last stage of the Cockcroft circuit 20. This high voltage is divided by a resistance breeder 413, and a voltage to be applied to a resistor $R_6$ is amplified by $IC_4$ ($IC_{4-1}$ and $IC_{4-2}$). The voltage amplified by the $IC_4$ is compared by the $IC_6$ with the target voltage setting voltage, and a voltage corresponding to a difference between them is applied to the transistor $Q_5$. Thereafter, the above operation is repeated, and the output voltage of the Cockcroft circuit 20 always maintains a predetermined value because of the target voltage setting voltage applied from the voltage setting terminal 412. This voltage is applied to the target 16*a* as the target voltage.

A target current is read from a diode $D_3$ provided to the first stage of the Cockcroft circuit 20. The read target current is voltage-converted by an $IC_{4-1}$, and the voltage obtained by conversion is applied to a comparator $IC_{7-1}$. The comparator $IC_{7-1}$ compares the applied voltage with a preset voltage (voltage corresponding to the maximum target current) adjusted by a variable resistor $VR_c$, and switching transistors $IC_8$ ($IC_{8-1}$, $IC_{8-2}$, $IC_{8-3}$, and $IC_{8-4}$) are operated in accordance with the comparison result. An output from the switching transistors $IC_8$ is supplied to the oscillator $IC_1$ to stop oscillation of the oscillator $IC_1$ when an overcurrent is generated. In this embodiment, since these circuits are incorporated, the respective ICs in the target voltage circuit 410 can be protected from an overcurrent caused by electric discharge of the microfocus X-ray tube 10, electric discharge in the mold block 21, and the like.

An output from the last stage of the Cockcroft circuit 20 is voltage-divided by the resistance breeder 413, and a voltage $R_7/(R_2+R_3 \ldots +R_7)$ times the output voltage is applied to a resistor $R_7$. The voltage of the resistor $R_7$ is amplified by the $IC_{4-2}$ and applied to a comparator $IC_{7-2}$. The comparator $IC_{7-2}$ compares the applied voltage with a preset voltage (maximum voltage with which an output from the Cockcroft circuit 20 is allowed) adjusted by a variable resistor $VR_v$, and the switching transistors $IC_8$ are operated in accordance with the comparison result. An output from the switching transistors $IC_8$ is supplied to the oscillator $IC_1$ to stop oscillation of the oscillator $IC_1$ when the output from the last stage of the Cockcroft circuit 20 exceeds the preset voltage adjusted by the variable resistor $VR_v$. In this embodiment, since these circuits are incorporated, even if a voltage exceeding the preset voltage is input from the outside, breakdown oscillation having a voltage exceeding the maximum voltage of the microfocus X-ray tube 10 will not occur, and the high-voltage driving ICs will not be damaged by electric discharge in the mold block 21. The voltage of the resistor $R_7$ obtained by voltage-dividing the output from the last stage of the Cockcroft circuit 20 is always monitored and displayed on the target voltage display meter 340.

Figure 17:
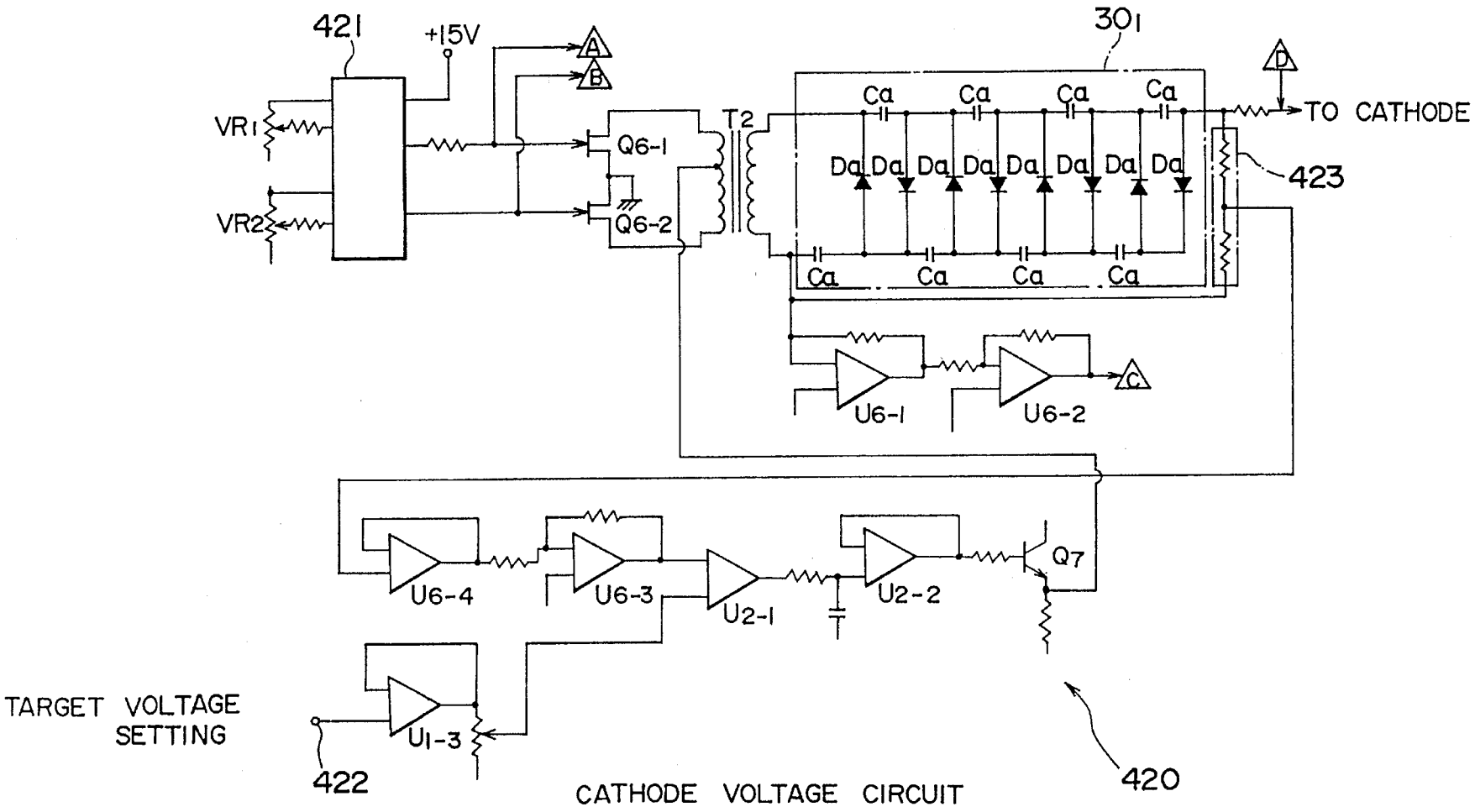
FIG. 17 is a circuit diagram showing the arrangement of a cathode voltage circuit.

FIG. 17 is a circuit diagram of the cathode controller 140. A cathode voltage circuit 420 shown in FIG. 17 has an oscillator 421 and switching transistors $Q_{6-1}$ and $Q_{6-2}$. Hence, the switching transistors $Q_{6-2}$ and $Q_{6-2}$ alternately perform an ON/OFF operation at an oscillation frequency output from the oscillator 421. when a voltage is applied to the intermediate point of the primary winding of a transformer $T_2$ connected to the switching transistors $Q_{6-1}$ and $Q_{6-2}$, this voltage serves as the voltage of the primary winding of the transformer $T_2$, and a voltage corresponding to the turn ratio is generated at the secondary winding of the transformer $T_2$. When a target voltage setting voltage is applied from the voltage setting D/A converter 210 to a voltage setting terminal 422, this voltage drives a transistor $Q_7$ through a comparator $U_{2-1}$. The output voltage from the transistor $Q_7$ is applied to the intermediate point of the transformer $T_2$, and a secondary voltage corresponding to the target voltage setting voltage is generated in the transformer $T_2$. A Cockcroft circuit $\mathbf{30}_1$ is connected to the secondary winding of the transformer $T_2$. The Cockcroft circuit $\mathbf{30}_1$ has a plurality of diodes Da and a plurality of capacitors Ca to generate a high voltage by amplifying the secondary voltage generated by the secondary winding of the transformer $T_2$. A high-voltage output from the Cockcroft circuit $\mathbf{30}_1$ is divided by a resistance breeder 423 and amplified by a buffer $U_{6-4}$ and an inverting amplifier $U_{6-3}$. An output voltage from the inverting amplifier $U_{6-3}$ is applied to the comparator $U_{2-1}$ and compared with the target voltage setting voltage applied to the voltage setting terminal 422. A voltage corresponding to the difference between them is supplied to the primary winding of the transformer $T_2$ through a buffer $U_{2-2}$. Hence, the output voltage from the Cockcroft circuit $\mathbf{30}_1$ maintains a predetermined value and is applied to the cathode 15*b* as the cathode voltage.

Figure 18:
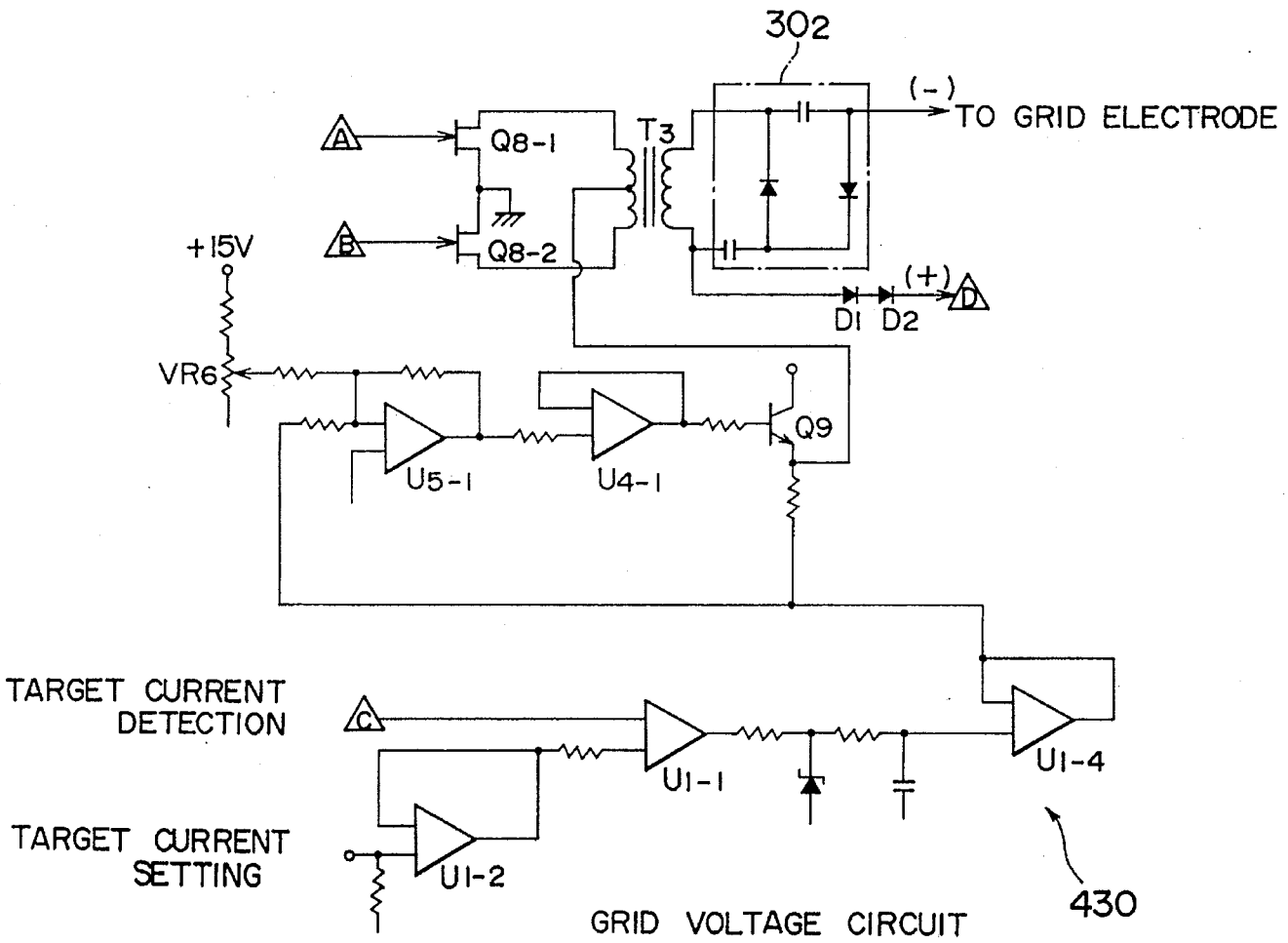
FIG. 18 is a circuit diagram showing the arrangement of a grid voltage circuit.

FIG. 18 is a circuit diagram of the grid controller 130. A grid voltage circuit 430 shown in FIG. 18 has switching transistors $Q_{8-1}$ and $Q_{8-2}$ and a transformer $T_3$. An output from the oscillator 421 provided to the cathode voltage circuit 420 is supplied to the switching transistors $Q_{8-1}$ and $Q_{8-2}$. Hence, the switching transistors $Q_{8-1}$ and $Q_{8-2}$ alternately perform an ON/OFF operation at an oscillation frequency supplied from the oscillator 421. A voltage capable of cutting off the target current of the microfocus X-ray tube 10 is set in a variable resistor $VR_6$ in advance. This preset voltage is applied to a transistor $Q_9$ through an inverting amplifier $U_{5-1}$ and a buffer $U_{4-1}$. Since an output voltage from the transistor $Q_9$ is applied to the intermediate point of the primary winding of the transformer $T_3$, this voltage is switched by the transistors $Q_{8-1}$ and $Q_{8-2}$ to form a voltage having an oscillation frequency component.

This frequency component is synchronized with the frequency component of the cathode voltage. A voltage corresponding to the turn ratio is generated in the secondary winding of the transformer $T_3$ and amplified by a Cockcroft circuit $\mathbf{30}_2$. The negative component of the amplified voltage is applied to the grid electrode 15*c* as the grid voltage. The positive component of the amplified voltage is applied to the cathode 15*b* as the cathode voltage. Hence, the grid voltage becomes lower than the cathode voltage. When the grid voltage and the cathode voltage are set in this manner, the amount of electrons emitted from the cathode 15*b* and flowing to the target 16*a* can be controlled by the grid electrode 15*c*. Namely, if the grid voltage is set to be much lower than the cathode voltage, the electrons flowing to the target 16*a* can be decreased. If the grid voltage is set to be slightly lower than the cathode voltage, the electrons flowing to the target 16*a* can be increased.

The cathode voltage output from the Cockcroft circuit $\mathbf{30}_1$ provided to the cathode voltage circuit 420 is divided by the resistance breeder 423, amplified by inverting amplifiers $U_{6-1}$and $U_{6-2}$, and applied to a comparator $U_{1-1}$. A target current setting voltage from the current setting D/A converter 220 is applied to a comparator $U_{1-2}$, and an output voltage from the comparator $U_{1-2}$ is applied to the comparator $U_{1-1}$. A voltage corresponding to a difference between these two voltages is output from the comparator $U_{1-1}$, and applied to the inverting amplifier $U_{5-1}$ and the buffer $U_{4-1}$ through a buffer $U_{1-4}$. An output voltage from the buffer $U_{4-1}$ is applied to the gate of the transistor $Q_9$, and an emitter output from the transistor $Q_9$ serves as the voltage of the primary winding of the transformer $T_3$.

Therefore, the grid voltage follows the cathode voltage and operates as the bias voltage which is controlled to become the preset target current. This bias voltage is controlled by the voltage of the primary winding of the transformer $T_2$, and its frequency becomes constant.

As described above, the grid voltage operates to follow the cathode voltage. For this reason, the target current can be controlled by setting the grid potential to be always lower than the cathode potential. As the grid potential becomes close to the cathode potential, the target current increases. Hence, the grid potential and the cathode potential must be set such that the grid potential becomes lower than the cathode potential even when a maximum target current flows due to the following reason. Electrons emitted from the cathode 15*b* are thermoelectrons heated by the heater electrode 15*a*. when the thermoelectrons are focused by the focus electrode 15*d* to have a diameter of about 10 μm, the current density becomes very high. When the target current exceeds 100 μA, the target 16*a* is burned or degraded due to the influence of the high current density. Thus, the significance of maintaining the grid potential to be lower than the cathode potential is very large.

In this embodiment, the circuit for providing the grid voltage and the circuit for providing the cathode voltage have polarities so that the grid potential is maintained to be lower than the cathode voltage. More specifically, diodes $D_1$ and $D_2$ are connected in series between the first stage of the Cockcroft circuit $\mathbf{30}_2$ and the last stage of the Cockcroft circuit $\mathbf{30}_1$ such that they have negative and positive polarities on their Cockcroft circuit $\mathbf{30}_2$ sides and Cockcroft circuit $\mathbf{30}_1$ sides, respectively. The grid potential becomes always lower than the cathode potential due to the rectifying function of the diodes $D_1$ and $D_2$, and burn and degradation of the target 16*a* caused by the high current density are prevented.

Figure 19:
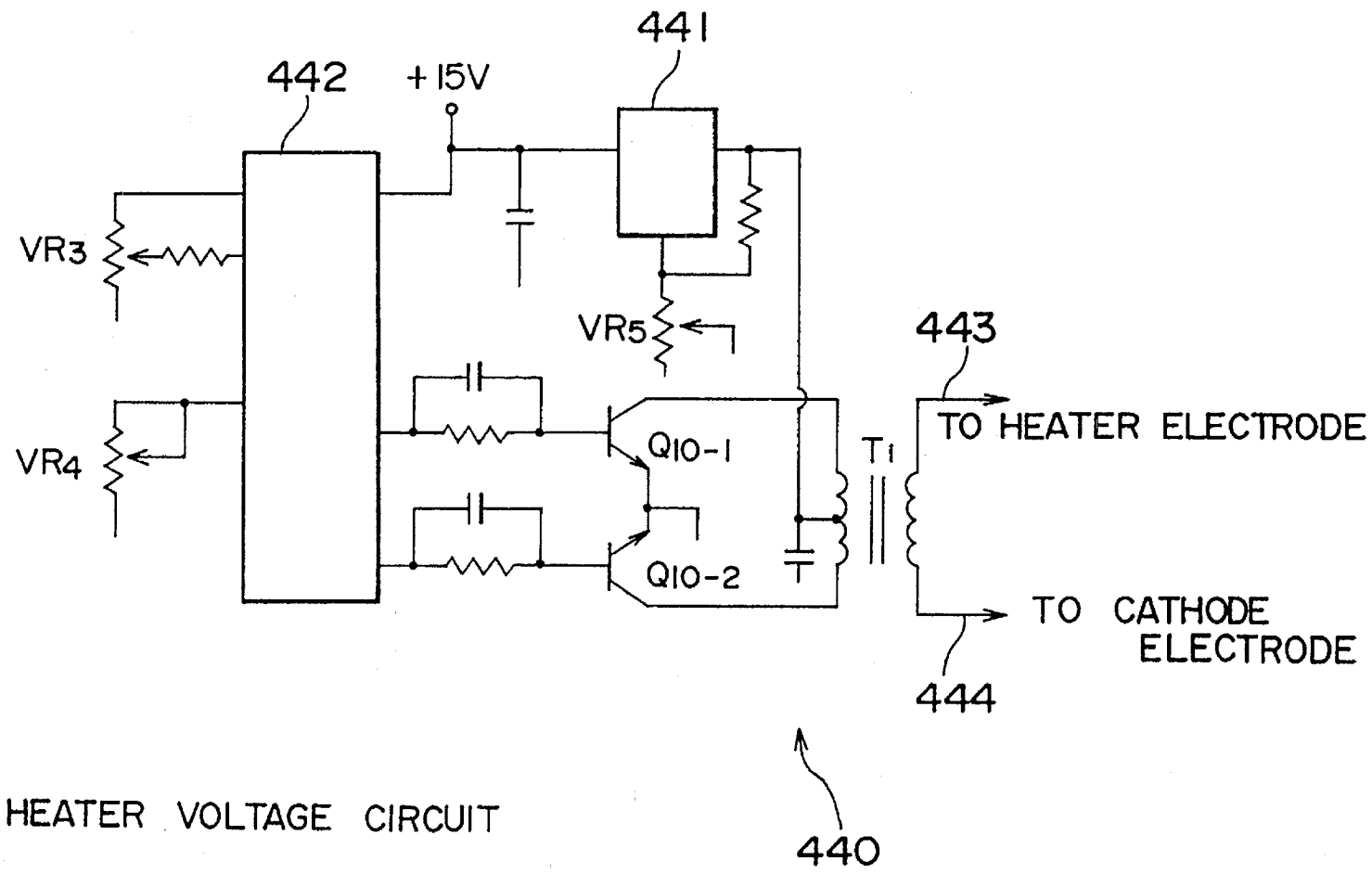
FIG. 19 is a circuit diagram showing the arrangement of a heater voltage circuit.

FIG. 19 is a circuit diagram of the heater controller 150. In a heater voltage circuit 440 shown in FIG. 19, a threeterminal regulator 441 is functioned such that a voltage adjusted by a variable resistor $VR_5$ is applied to the intermediate point of a transformer $T_1$. Switching transistors $Q_{10}$ ($Q_{10-1}$ and $Q_{10-2}$) alternately perform an ON/OFF operation at an oscillation frequency supplied from an oscillator 442. The collector voltage of the switching transistors $Q_{10}$ is applied to the two terminals of the primary winding of the transformer $T_1$. Hence, the voltage of the primary winding of the transformer $T_1$ is a voltage having an oscillation frequency component. The voltage of the primary winding of the transformer $T_1$ is adjusted by the variable resistor $VR_5$ that applies a voltage to the intermediate point of the transformer $T_1$.

The voltage of the secondary winding of the transformer $T_1$ is controlled by the voltage of the primary winding thereof, and its frequency becomes constant. One terminal 443 of the secondary winding of the transformer $T_1$ is connected to the heater electrode 15*a* and the other terminal 444 thereof is connected to have a cathode potential. That is, the heater voltage circuit 440 is connected to the negative electrode of the cathode 15*b* which is at a high negative potential lower than the ground potential. Since the cathode voltage changes interlocked with a change in target voltage, the potential on the heater voltage circuit 440 changes in accordance with the change in cathode voltage.

Assuming that the tube voltage of the microfocus X-ray tube 10 is set at 70 kV and that the tube current thereof is set at 100 μA, when the target voltage is changed from 0 to +70 kV, the cathode voltage is changed in an interlocked manner from 0 to −700 V. Thus, the heater voltage circuit 440 has a potential of a maximum of (−)700 v.

When one terminal 443 of the secondary winding of the transformer $T_1$ is grounded, the cathode voltage is directly applied to the heater voltage circuit 440. When the cathode voltage is applied to the heater voltage circuit 440, the output from the Cockcroft circuit $\mathbf{30}_1$ flows to the heater electrode 15*a*. When this current is increased, the heater electrode 15*a* may sometimes be burned.

In this embodiment, the current output from the Cockcroft circuit $\mathbf{30}_1$ is set to be sufficiently smaller than the current output from the heater voltage circuit 440. Therefore, the Cockcroft circuit $\mathbf{30}_1$ merely causes a voltage drop and the output current from the Cockcroft circuit $\mathbf{30}_1$ will not influence the heater electrode 15*a*. More specifically, the Cockcroft circuit $\mathbf{30}_1$ for generating the cathode voltage comprises eight capacitor stages having a static capacitance of 2,200 PF. It is experimentally apparent that a current output from such a Cockcroft circuit $\mathbf{30}_1$ is as small as about 300 μA at maximum. On the other hand, when a target current of 100 μA is generated, a voltage of a maximum of about 6.3 V is applied to the heater electrode 15*a*, and the current flowing through the heater electrode 15*a* becomes about 300 mA. In this manner, since the current flowing in the heater electrode 15*a* is sufficiently larger than the current output from the Cockcroft circuit $\mathbf{30}_1$, the output current from the Cockcroft circuit $\mathbf{30}_1$ will not influence the heater electrode 15*a*.

Figure 20:
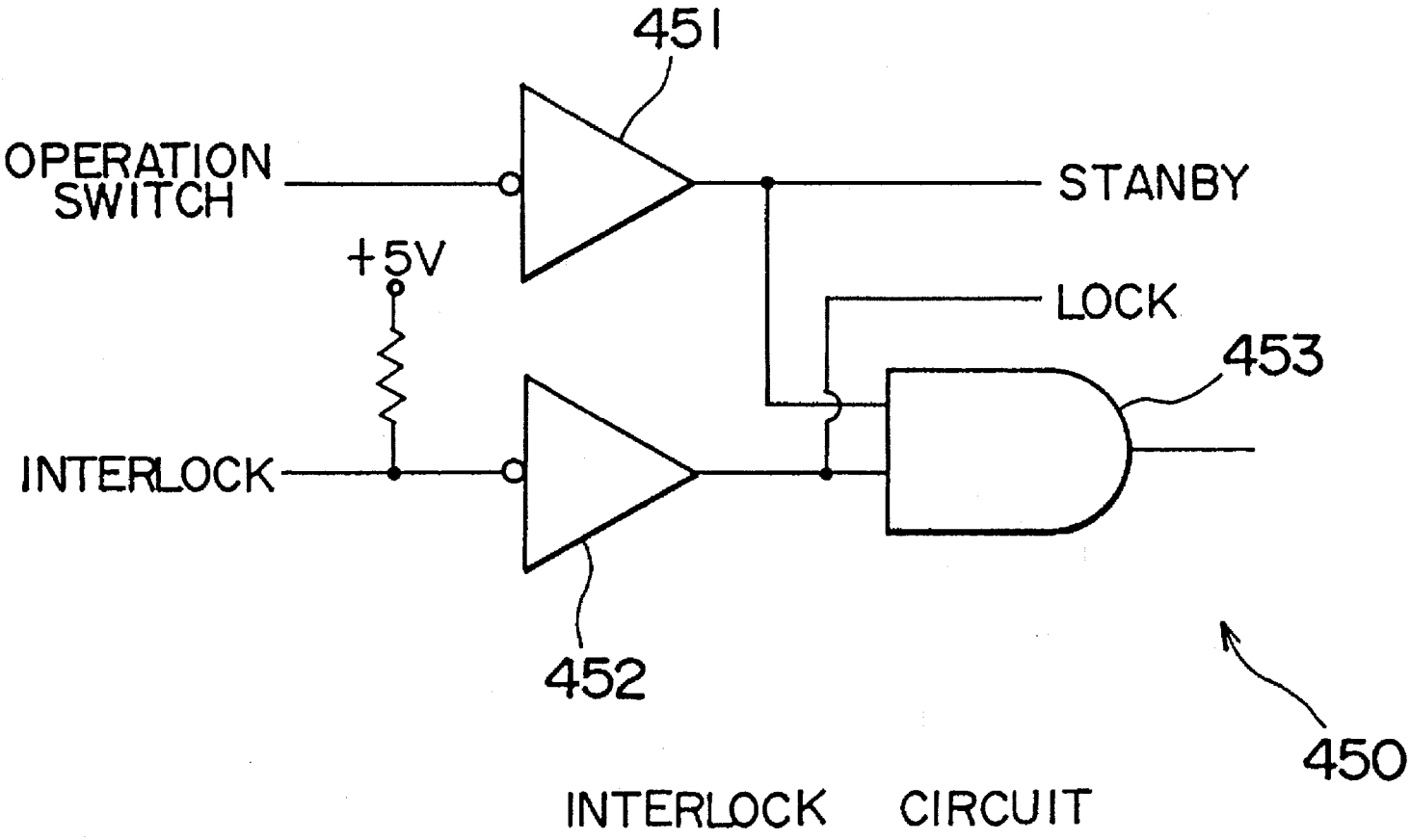
FIG. 20 is a circuit diagram showing the arrangement of an interlock circuit.
Figure 21:
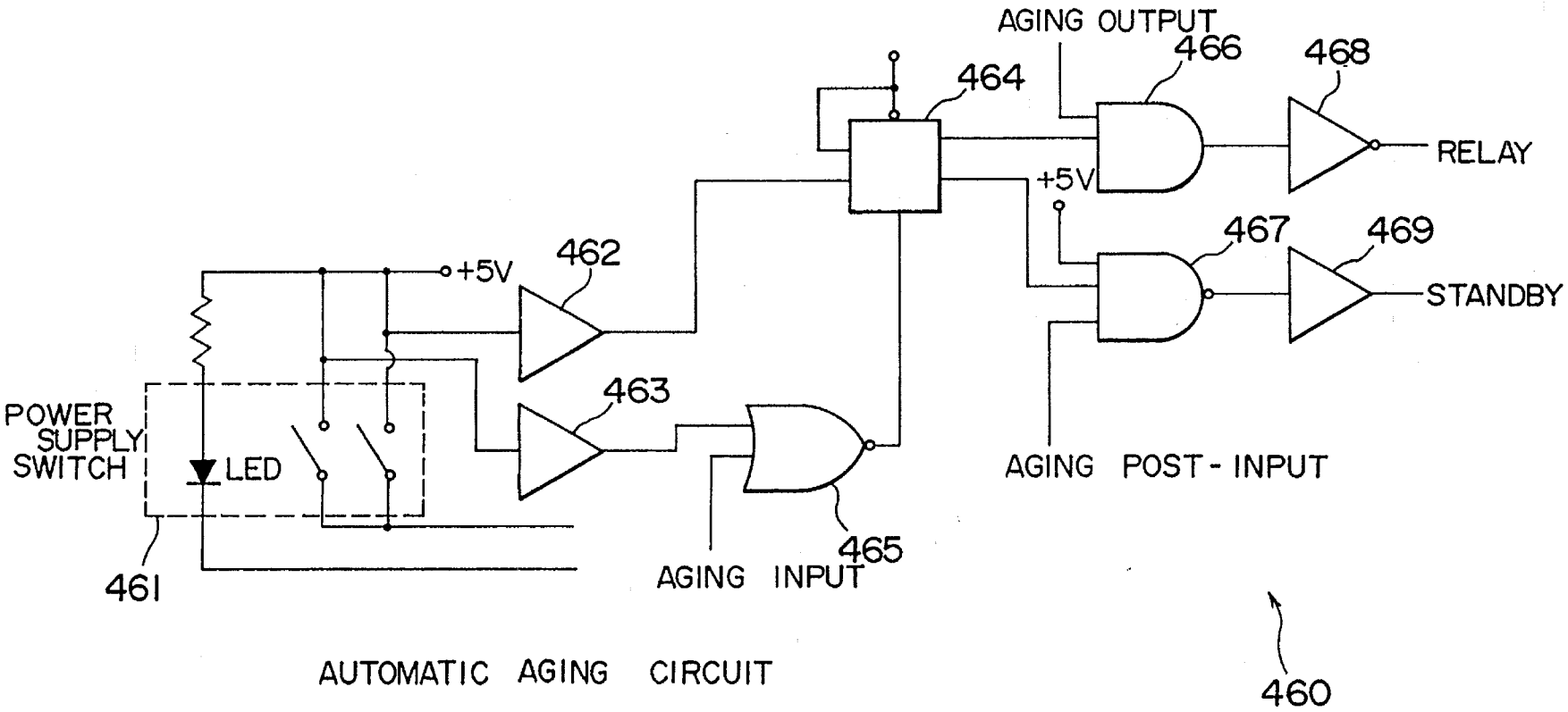
FIG. 21 is a circuit diagram showing the arrangement of an automatic aging circuit.
Figure 22:
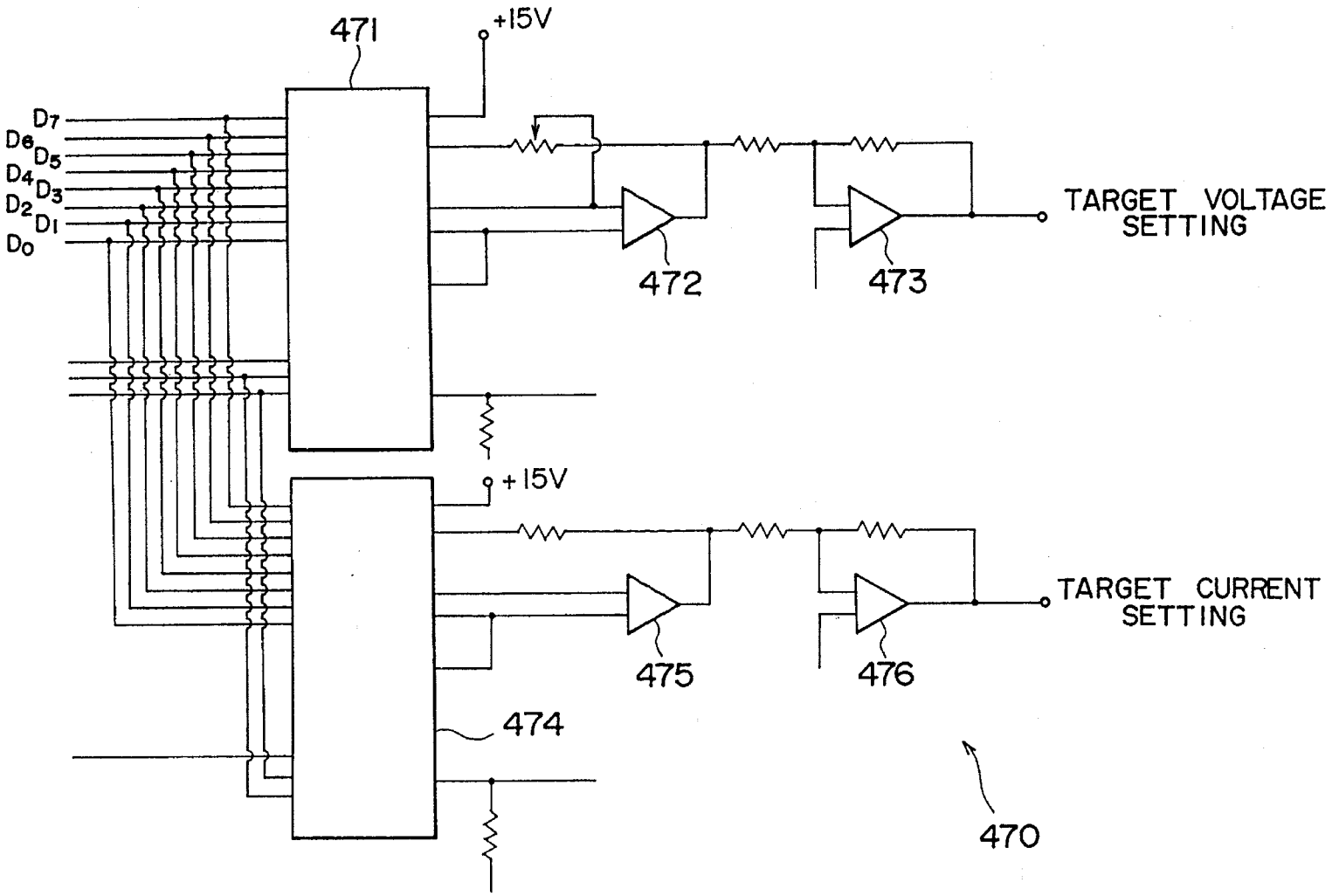
FIG. 22 is a circuit diagram showing the arrangement of a converter circuit.
Figure 23:
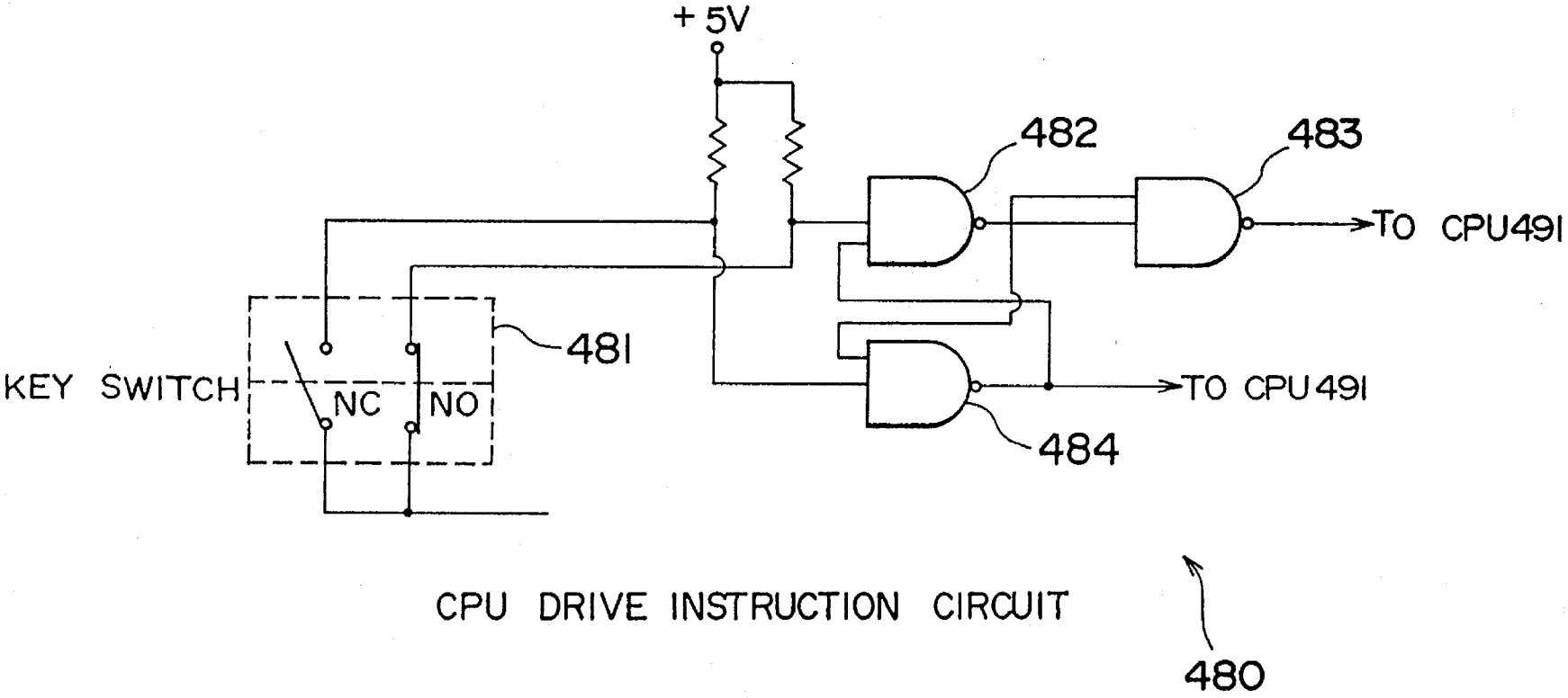
FIG. 23 is a circuit diagram showing the arrangement of a CPU drive instruction circuit.
Figure 24:
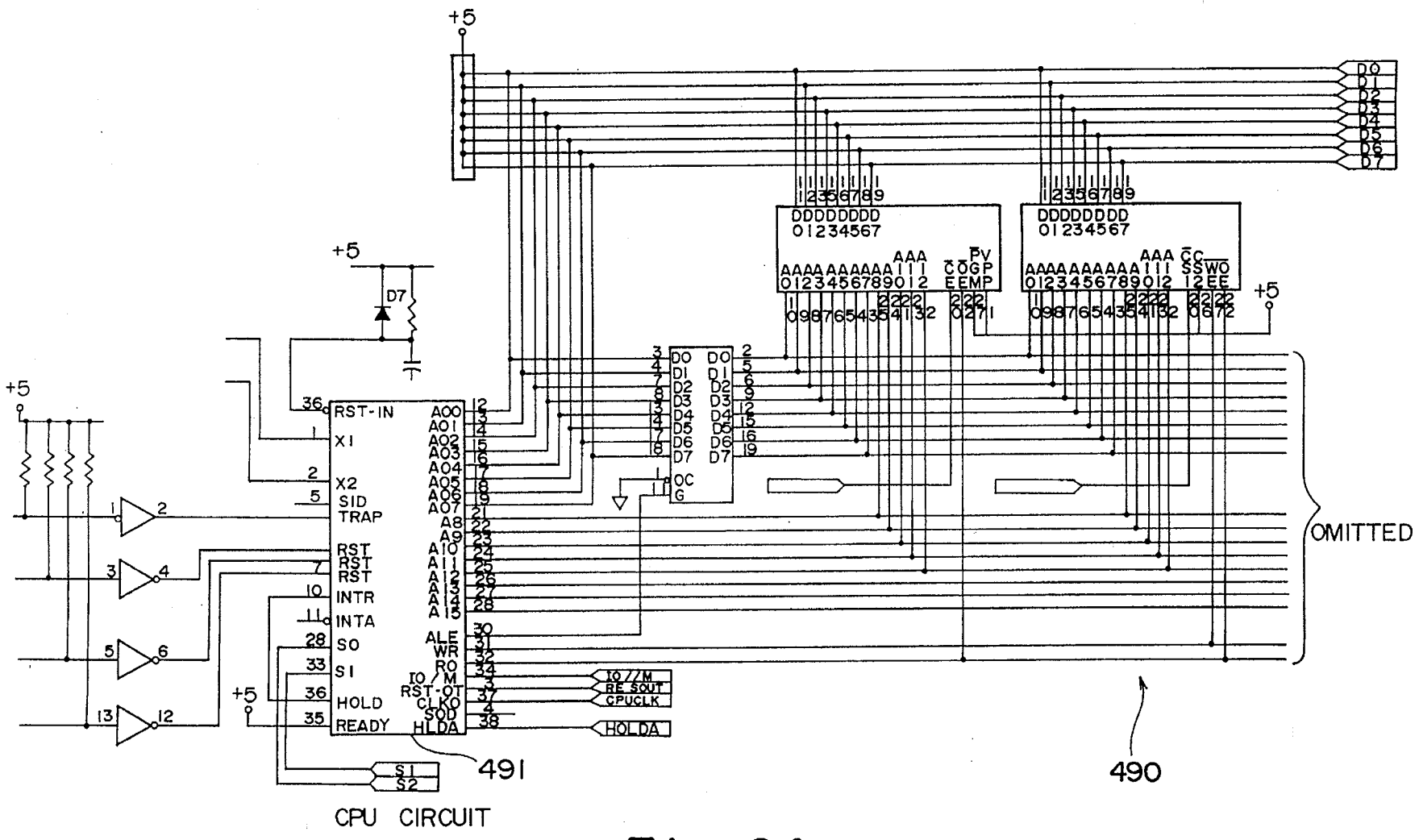
FIG. 24 is a circuit diagram showing the arrangement of a CPU circuit.

FIGS. 20 to 24 are circuit diagrams showing the respective circuits of the control block 200. FIG. 20 is a circuit diagram of an interlock circuit 450 constituting the interlock detector 230. FIG. 21 is a circuit diagram of an automatic aging circuit 460 constituting the aging unit 240. FIG. 22 is a circuit diagram of a converter circuit 470 constituting the voltage setting D/A converter 210 and the current setting D/A converter 220. FIG. 23 is a circuit diagram of a CPU drive instruction circuit 480 constituting the peripheral circuits of the CPU 360. FIG. 24 is a circuit diagram of a CPU circuit 490 constituting the CPU 360.

When a power switch 461 of the automatic aging circuit 460 is turned on, an interlock state is detected by an AND gate 453 of the interlock circuit 450. When an operation enable state is detected, a program stored in the CPU 491 of the CPU circuit 490 is executed, and an AGING instruction signal is supplied to a NOR gate 465. A flip-flop 464 and NAND gates 466 and 467 are driven by the AGING instruction signal, and a target voltage setting voltage and a target current setting voltage are given as the outputs from D/A converters 471 and 474 of the converter circuit 470. When these preset voltages are supplied, the respective circuits of the operation block 100 are driven, thereby performing warm-up optimum to the microfocus X-ray tube 10.

After warm-up is completed, the CPU 491 supplies an instruction to the NAND gate 467, and an output from a comparator 469 is switched to a standby state (a preparatory state for setting the target voltage and the target current of the microfocus X-ray tube 10 from the outside) .

This embodiment is provided with a function of stopping generation of the X-rays by the microfocus X-ray tube 10 by using a key switch 481 of the CPU drive instruction circuit 480. The key switch 481 has an NC switch and an NO switch. When the NC switch is turned on before generation of the X-rays, a NAND gate 484 outputs a signal to the CPU 491, and the CPU 491 outputs an automatic warm-up operation signal. When the NO switch is turned on after generation of the X-rays, a NAND gate 482 supplies an operation switch signal to the CPU 491. Upon turn-on operation of the NO switch, the CPU 491 drives an inverter 451 of the interlock circuit 450 by the program incorporated in it, thereby switching the output of the inverter 451 to the standby state.

Furthermore, the CPU 491 supplies instructions to the D/A converters 471 and 474 to reset all the previous preset signals such that the target voltage and the target current are set to the initial state (target voltage=0 V, target current=0 μA).

Figure 25:
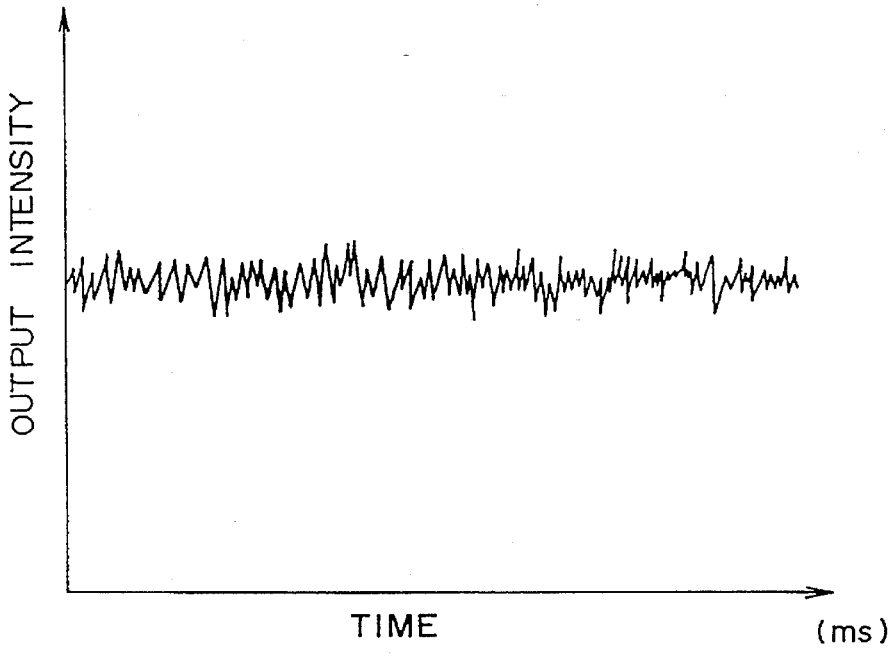
Fig. 25 (PRIOR ART)
FIG. 25 is a graph showing a variation in output intensity measured by using a conventional X-ray apparatus (PWM scheme)
Figure 26:
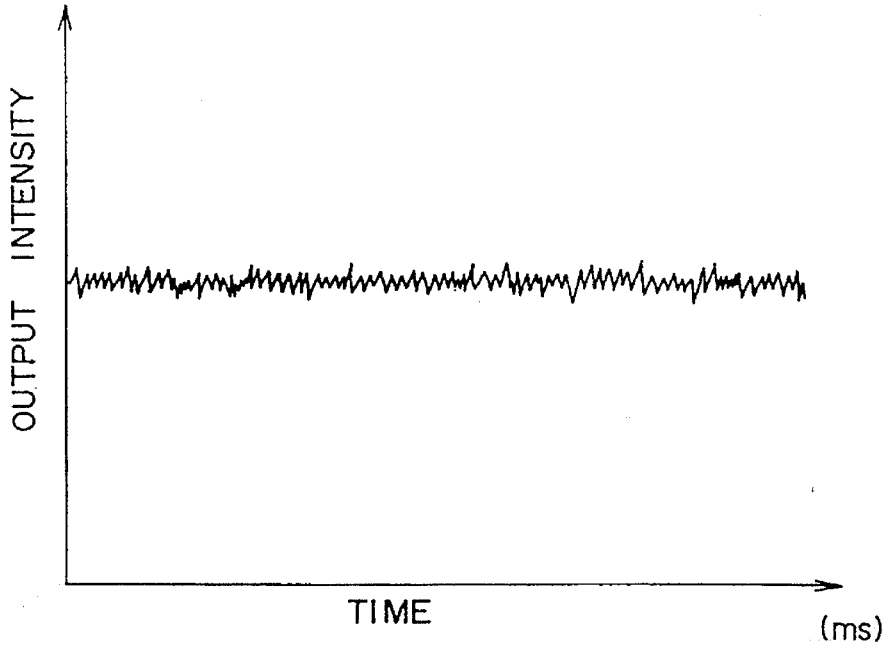
FIG. 26 is a graph showing a variation in output intensity measured by using the X-ray apparatus of this embodiment.

FIG. 25 is a graph showing a variation in output intensity measured by using a conventional X-ray apparatus (PWM scheme), and FIG. 26 is a graph showing a variation in output intensity measured by using the X-ray apparatus of this embodiment. In either X-ray apparatus, the target voltage is set to 40 kV and the target current is set to 10 μA. It is apparent from FIGS. 25 and 26 that the X-ray apparatus of this embodiment has a more stable output than that of the conventional apparatus. More specifically, the respective voltage generating circuits (the target voltage circuit 410, the cathode voltage circuit 420, and the like) of the X-ray apparatus of this embodiment are of a pulse voltage variable control scheme, so that they can perform control with stable driving between a low voltage and a high voltage. As a result, in this embodiment, a stable X-ray output substantially free from variations can be maintained, thus providing a remarkable effect when used with a low target voltage and a low target current as in high-precision measurement.

As has been described above in detail, according to the X-ray apparatus of this embodiment, since the focus electrode 15*d* maintains the ground potential and does not vary, the focus diameter of the electrons bombarded against the target 16*a* becomes constant, thereby stabilizing an X-ray output. Since the potential ratio of the cathode 15*b* to the target 16*a* is always constant, the electric field distribution between the cathode 15*b* and the target 16*a* is stabilized, thereby stabilizing the X-ray output. Since the metal envelope 12 maintains the ground potential, the electric field distribution between the cathode 15*b* and the target 16*a* will not be substantially disturbed by being influenced from the outside. Hence, the X-ray output will not vary due to the disturbance in electric field distribution between the cathode 15*b* and the target 16*a*. In this manner, when the X-ray apparatus of this embodiment is used, an X-ray output having a small variation can be obtained.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

The basic Japanese Application No. 175734 filed on Jul. 15, 1993 is hereby incorporated by reference.

What is claimed is:

1. An X-ray apparatus comprising:

an X-ray tube including:

a cathode for emitting electrons when heated by a heater, a target for generating X-rays when bombarded by the electrons emitted from said cathode, and a focus electrode for maintaining a ground potential and for focusing the electrons emitted from said cathode so that the electrons bombard said target; and a control circuit for changing a cathode voltage to be applied to said cathode and a target voltage to be applied to said target, the cathode voltage and target voltage being changed based on an interlocking relationship to maintain a constant ratio of cathode voltage to target voltage, whereby the cathode and target voltages are changed on negative and positive sides of the ground potential of said focus electrode in an interlocked manner, respectively.

2. An apparatus according to claim 1, wherein said X-ray tube further includes an electrically conductive envelope in which said cathode, said target and said focus electrode are arranged, said envelope having an exit window through which the X-rays generated by said target emerge to an outside area.

3. An apparatus according to claim 2, wherein said focus electrode is electrically connected to said envelope, said focus electrode and said envelope maintaining the ground potential.

4. An apparatus according to claim 1, wherein said control circuit includes:

a first voltage generating circuit for receiving an externally supplied voltage signal, for voltage-amplifying the received voltage signal based on a predetermined ratio, and for applying the amplified voltage signal to said target; and a second voltage generating circuit for receiving the externally supplied voltage signal, for voltage-amplifying the received voltage signal based on a ratio different from the predetermined ratio, and for applying the amplified voltage signal to said cathode.

5. An apparatus according to claim 4, further comprising a generating circuit mold block for molding said first and second generating circuits with a resin, wherein said control circuit is of a pulse voltage variable control scheme.

6. An apparatus according to claim 4, wherein said first voltage generating circuit includes means for detecting at least one of an abnormal overcurrent state and an abnormal overvoltage state and for stopping an operation of said first voltage generating circuit upon detection of an abnormality based on said detected state, and said second voltage generating circuit includes a current capacitance of not more than 1/100 times a current capacitance of the heater which heats said cathode.

7. An apparatus according to claim 4, further comprising:

a grid electrode located between said cathode and said focus electrode for accelerating the electrons emitted from said cathode; and wherein said control circuit further includes:

a third voltage generating circuit for applying a high voltage to said grid electrode, and a diode, connected between said second and third voltage generating circuits, for passing a current from said third voltage generating circuit to said second voltage generating circuit, said first voltage generating circuit applying a high positive voltage to said target and said second voltage generating circuit applying a high negative voltage to said cathode.

8. An apparatus according to claim 7, further comprising:

alumina pillars for assembling and fixing said cathode, said grid electrode, and said focus electrode by adhesion with glass or silver, wherein said target includes an oxygen-free copper base, an electron incident surface of said oxygen-free copper base having tungsten (W) brazed with silver located thereon, and wherein said focus electrode and said grid electrode include molybdenum (Mo), said cathode is covered with iridium (Ir), and said envelope includes a nickel-copper alloy.

9. An apparatus according to claim 1, further comprising:

an X-ray tube mold block having an insertion hole within which said X-ray tube is inserted and fixed, an insulating oil or insulating gas ($SF_6$) being sealed in said insertion hole for high-voltage insulation of said X-ray tube, and a coating of epoxy resin covering an open end face of said insertion hole to prevent leakage and evaporation of the insulating oil.

10. An apparatus according to claim 1, wherein the target is subject to the ground potential maintained by the focus electrode.

* * * * *